US008636580B2

(12) United States Patent
Inamura et al.

(10) Patent No.: US 8,636,580 B2
(45) Date of Patent: Jan. 28, 2014

(54) SLOT MACHINE EXECUTING FREE GAME AND CONTROL METHOD THEREOF

(75) Inventors: Yukinori Inamura, Tokyo (JP); Hiroki Saito, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 976 days.

(21) Appl. No.: 12/589,512

(22) Filed: Oct. 28, 2008

(65) Prior Publication Data

US 2010/0105466 A1 Apr. 29, 2010

(51) Int. Cl.
*A63F 9/24* (2006.01)

(52) U.S. Cl.
USPC ..... 463/20; 463/21

(58) Field of Classification Search
USPC ..... 463/20, 21
See application file for complete search history.

(56) References Cited

U.S. PATENT DOCUMENTS

| | | | | |
|---|---|---|---|---|
| 6,012,983 | A | 1/2000 | Walker et al. | |
| 6,093,102 | A | 7/2000 | Bennett | |
| 6,261,178 | B1 * | 7/2001 | Bennett | 463/20 |
| 6,764,397 | B1 * | 7/2004 | Robb | 463/23 |
| 6,960,133 | B1 | 11/2005 | Marks et al. | |
| 7,713,121 | B1 * | 5/2010 | Luciano et al. | 463/25 |
| 2003/0139214 | A1 * | 7/2003 | Wolf et al. | 463/42 |
| 2004/0235551 | A1 * | 11/2004 | Walker et al. | 463/16 |
| 2006/0258422 | A1 * | 11/2006 | Walker et al. | 463/7 |
| 2007/0105622 | A1 * | 5/2007 | Okada | 463/29 |
| 2007/0243935 | A1 * | 10/2007 | Huizinga | 463/42 |
| 2008/0051177 | A1 | 2/2008 | Okada | |
| 2008/0058066 | A1 * | 3/2008 | Okada | 463/20 |
| 2008/0064472 | A1 | 3/2008 | Okada | |
| 2008/0064480 | A1 * | 3/2008 | Randall | 463/20 |
| 2008/0070695 | A1 * | 3/2008 | Baerlocher et al. | 463/42 |
| 2008/0081687 | A1 * | 4/2008 | Blumel | 463/20 |
| 2010/0120506 | A1 * | 5/2010 | Davis et al. | 463/20 |

FOREIGN PATENT DOCUMENTS

| | | |
|---|---|---|
| AU | 200119729 | 9/2001 |
| CN | 101136120 | 3/2008 |

* cited by examiner

*Primary Examiner* — Pierre E Elisca
(74) *Attorney, Agent, or Firm* — Sheppard, Mullin, Richter & Hampton LLP

(57) ABSTRACT

According to a slot machine of the present invention, a free game is executed when a predetermined condition is satisfied. In the free game, an amount of payout is determined based upon an amount of game media, which is obtained by dividing a total amount of the game media betted in the normal game by the number of BETs. Further, game media of the determined amount of payout are paid out.

23 Claims, 27 Drawing Sheets

FIG. 5

| | | First array | Second array | Third array | Fourth array | Fifth array |
|---|---|---|---|---|---|---|
| Code No. | Random number value | Symbol | Symbol | Symbol | Symbol | Symbol |
| 00 | 0～3277 | J | WILD | A | Q | J |
| 01 | 3278～6555 | Q | A | J | J | A |
| 02 | 6556～9833 | FLOWER1 | Q | FLOWER1 | FLOWER1 | FLOWER1 |
| 03 | 9834～13111 | J | WILD | 10 | Q | J |
| 04 | 13112～16389 | Q | WILD | FLOWER2 | K | A |
| 05 | 16390～19667 | FLOWER2 | WILD | FLOWER1 | FLOWER1 | FISH |
| 06 | 19668～22945 | A | FISH | FEATURE | A | FLOWER2 |
| 07 | 22946～26223 | BIRD | BIRD | A | K | FEATURE |
| 08 | 26224～29501 | 10 | K | J | 9 | K |
| 09 | 29502～32779 | 9 | FLOWER2 | 9 | Q | 9 |
| 10 | 32780～36057 | A | WILD | A | BIRD | Q |
| 11 | 36058～39335 | Q | A | Q | 10 | FLOWER1 |
| 12 | 39336～42613 | 10 | 9 | BIRD | FEATURE | K |
| 13 | 42614～45891 | FLOWER2 | BIRD | K | K | BIRD |
| 14 | 45892～49169 | K | J | FISH | 10 | 10 |
| 15 | 49170～52447 | A | WILD | Q | BIRD | J |
| 16 | 52448～55725 | WILD | 10 | FEATURE | A | WILD |
| 17 | 55726～59003 | J | FLOWER1 | A | WILD | WILD |
| 18 | 59004～62281 | Q | WILD | WILD | FISH | WILD |
| 19 | 62282～65535 | FISH | FEATURE | WILD | FLOWER2 | Q |

(Range of random number value:0～65535)

FIG. 7

| Symbol | Number of rearranged symbols | | | |
|---|---|---|---|---|
| | Two symbols | Three symbols | Four symbols | Five symbols |
| 10 | 2 | 4 | 6 | 8 |
| J | 3 | 6 | 9 | 12 |
| Q | 30 | 60 | 90 | 120 |
| K | 10 | 20 | 30 | 40 |
| FLOWER1 | 5 | 10 | 15 | 20 |
| FLOWER2 | 8 | 16 | 24 | 32 |
| BIRD | 15 | 30 | 45 | 60 |
| FISH | 25 | 50 | 75 | 100 |
| FEATURE | Free game (※) | | | |

※Free game is played when three or more symbols are rearranged.

FIG. 15

Table for determining the number of to-be-added special symbols

| Number of to-be-added special symbols | Random number value |
|---|---|
| 10 | 0～13106 |
| 20 | 13107～26214 |
| 30 | 26215～39321 |
| 40 | 39322～52428 |
| 50 | 52429～65535 |

(Range of random number value:0～65535)

FIG. 17

Symbol-array determination table

| Symbol array No. | Random number value |
|---|---|
| 1 | 0～13106 |
| 2 | 13107～26214 |
| 3 | 26215～39321 |
| 4 | 39322～52428 |
| 5 | 52429～65535 |

(Range of random number value:0～65535)

FIG. 18

Code-number determination table

| Random number value | Code No. |
|---|---|
| 0～2978 | 00 |
| 2979～5957 | 01 |
| 5958～8936 | 02 |
| 8937～11915 | 03 |
| 11916～14894 | 04 |
| 14895～17873 | 05 |
| 17874～20852 | 06 |
| 20853～23831 | 07 |
| 23832～26810 | 08 |
| 26811～29789 | 09 |
| 29790～32768 | 10 |
| 32769～35747 | 11 |
| 35748～38726 | 12 |
| 38727～41705 | 13 |
| 41706～44684 | 14 |
| 44685～47663 | 15 |
| 47664～50642 | 16 |
| 50643～53621 | 17 |
| 53622～56600 | 18 |
| 56601～59579 | 19 |
| 59580～62558 | 20 |
| 62559～65535 | End |

FIG. 19A

| First array | | | Second array | | | Third array | | |
|---|---|---|---|---|---|---|---|---|
| Code No. | Random number value | Symbol | Code No. | Random number value | Symbol | Code No. | Random number value | Symbol |
| 00 | 0～2849 | J | 00 | 0～3119 | WILD | 00 | 0～2978 | A |
| 01 | 2850～5700 | Q | 01 | 3120～6240 | A | 01 | 2979～5957 | J |
| 02 | 5701～8551 | FLOWER1 | 02 | 6241～9361 | Q | 02 | 5958～8936 | FLOWER1 |
| 03 | 8552～11402 | J | 03 | 9362～12482 | WILD | 03 | 8937～11915 | 10 |
| 04 | 11403～14253 | Q | 04 | 12483～15603 | WILD | 04 | 11916～14894 | FLOWER2 |
| 05 | 14254～17104 | FLOWER2 | 05 | 15604～18723 | WILD | 05 | 14895～17873 | FLOWER1 |
| 06 | 17105～19955 | A | 06 | 18724～21844 | FISH | 06 | 17874～20852 | WILD |
| 07 | 19956～22806 | BIRD | 07 | 21845～24965 | BIRD | 07 | 20853～23831 | FEATURE |
| 08 | 22807～25657 | 10 | 08 | 24966～28086 | K | 08 | 23832～26810 | A |
| 09 | 25658～28508 | 9 | 09 | 28087～31207 | FLOWER2 | 09 | 26811～29789 | J |
| 10 | 28509～31359 | A | 10 | 31208～34328 | WILD | 10 | 29790～32768 | 9 |
| 11 | 31360～34210 | Q | 11 | 34329～37449 | A | 11 | 32769～35747 | A |
| 12 | 34211～37061 | 10 | 12 | 37450～40570 | WILD | 12 | 35748～38726 | Q |
| 13 | 37062～39912 | WILD | 13 | 40571～43691 | 9 | 13 | 38727～41705 | WILD |
| 14 | 39913～42763 | FLOWER2 | 14 | 43692～46812 | BIRD | 14 | 41706～44684 | BIRD |
| 15 | 42764～45614 | K | 15 | 46813～49933 | J | 15 | 44685～47663 | K |
| 16 | 45615～48465 | A | 16 | 49934～53054 | WILD | 16 | 47664～50642 | FISH |
| 17 | 48466～51316 | WILD | 17 | 53055～56175 | 10 | 17 | 50643～53621 | Q |
| 18 | 51317～54167 | J | 18 | 56176～59296 | FLOWER1 | 18 | 53622～56600 | FEATURE |
| 19 | 54168～57018 | Q | 19 | 59297～62417 | WILD | 19 | 56601～59579 | A |
| 20 | 57019～59869 | FISH | 20 | 62418～65535 | FEATURE | 20 | 59580～62558 | WILD |
| 21 | 59870～62720 | WILD | | | | 21 | 62559～65535 | WILD |
| 22 | 62721～65535 | WILD | | | | | | |

(Range of random number value:0～65535)

FIG. 19B

| Fourth array | | | Fifth array | | |
|---|---|---|---|---|---|
| Code No. | Random number value | Symbol | Code No. | Random number value | Symbol |
| 00 | 0~2978 | Q | 00 | 0~2978 | J |
| 01 | 2979~5957 | J | 01 | 2979~5957 | A |
| 02 | 5958~8936 | FLOWER1 | 02 | 5958~8936 | FLOWER1 |
| 03 | 8937~11915 | Q | 03 | 8937~11915 | J |
| 04 | 11916~14894 | K | 04 | 11916~14894 | A |
| 05 | 14895~17873 | FLOWER1 | 05 | 14895~17873 | FISH |
| 06 | 17874~20852 | A | 06 | 17874~20852 | FLOWER2 |
| 07 | 20853~23831 | K | 07 | 20853~23831 | FEATURE |
| 08 | 23832~26810 | 9 | 08 | 23832~26810 | K |
| 09 | 26811~29789 | Q | 09 | 26811~29789 | 9 |
| 10 | 29790~32768 | BIRD | 10 | 29790~32768 | Q |
| 11 | 32769~35747 | WILD | 11 | 32769~35747 | FLOWER1 |
| 12 | 35748~38726 | WILD | 12 | 35748~38726 | K |
| 13 | 38727~41705 | 10 | 13 | 38727~41705 | BIRD |
| 14 | 41706~44684 | FEATURE | 14 | 41706~44684 | 10 |
| 15 | 44685~47663 | K | 15 | 44685~47663 | J |
| 16 | 47664~50642 | 10 | 16 | 47664~50642 | WILD |
| 17 | 50643~53621 | BIRD | 17 | 50643~53621 | WILD |
| 18 | 53622~56600 | A | 18 | 53622~56600 | WILD |
| 19 | 56601~59579 | WILD | 19 | 56601~59579 | WILD |
| 20 | 59580~62558 | FISH | 20 | 59580~62558 | WILD |
| 21 | 62559~65535 | FLOWER2 | 21 | 62559~65535 | Q |

(Range of random number value:0~65535)

SLOT MACHINE EXECUTING FREE GAME AND CONTROL METHOD THEREOF

BACKGROUND OF THE INVENTION

1. Field of the Invention

The present invention relates to a slot machine that executes a free game and a control method thereof.

2. Discussion of the Background

There have conventionally been known slot machines that scroll-display and then stop-display a plurality of kinds of symbols and provide a predetermined amount of game media (e.g. a predetermined number of coins, a predetermined amount of money) based upon a combination of the stop-displayed symbols. Such slot machines are disclosed in, for example, U.S. Pat. No. 6,960,133, U.S. Pat. No. 6,012,983, and U.S. Pat. No. 6,093,102.

Among such slot machines, there exists a slot machine executing a free game in a case where a predetermined condition (e.g. rearrangement of the specific symbol in a slot machine game) is satisfied in a game. The free game is a game conducted without a BET of game media. For example, AU-1972901-A discloses a slot machine which executes a free game as a side game when a predetermined condition (specific rearrangement of symbols) has been satisfied.

Since a player can play a game without consuming game media in the free game, the player is generally playing a game with strong expectations for generation of the free game. Further, since the free game is a big chance, for the player to acquire game media, an amount of the game media to be paid out in the free game is of great concern for the player.

Accordingly, the inventors of the present invention have come to consider that adding a new feature concerning the amount of the game media to be paid out in the free game can enhance the player's interest and concern for the game.

The present invention was made in view of the aforementioned issue and an object thereof is to provide a slot machine capable of enhancing the player's interest and concern for the game, and a control method thereof.

SUMMARY OF THE INVENTION

The present invention provides a slot machine having the following configuration.

Namely, the slot machine comprises: a BET input device capable of receiving an input of a BET; a symbol display capable of variably displaying a plurality of symbols; and a controller. The controller is programmed to execute processing of: (A) receiving an input of a BET through the BET input device; (B) executing a normal game in which the plurality of symbols are variably displayed and then stop-displayed to the symbol display after the input of the BET in the processing (A), an amount of payout is determined based upon a stop-displayed symbol or a combination of stop-displayed symbols and an amount of game media betted in the processing (A), and game media of the determined amount of payout are paid out; (C) calculating an amount of game media, which is obtained by dividing a total amount of the game media betted in the processing (A) by the number of BETs; and (D) executing a free game when a predetermined condition is satisfied, the free game being a game in which the plurality of symbols are variably displayed and then stop-displayed to the symbol display even without a BET of game media, the amount of payout is determined based upon a stop-displayed symbol or a combination of stop-displayed symbols and the amount of game media calculated in the processing (C), and game media of the determined amount of payout are paid out.

According to the above-mentioned slot machine, the free game is executed when a predetermined condition is satisfied. In the free game, the amount of payout is determined based upon the amount of the game media obtained by dividing the total amount of the game media betted in the normal games by the number of BETs. Namely, the amount of payout is determined based upon an average value of the amount of the game media betted in the normal games (hereinafter, also referred to as an average value of the amount of BET). Then, game media of the determined amount of payout are paid out. Namely, the amount of the game media to be paid out in the free game is determined based upon the average value of the amount of the game media betted in the normal games.

The average value of the amount of the game media betted in the normal games represents the amount invested by the player in the normal games, and is a symbol for the player, which represents his or her effort made until the free game is generated.

According to the above-mentioned slot machine, the amount of the game media to be paid out in the free game is determined based upon this kind of value, and therefore, it is possible to provide the player with a certain sense of achievement in that his or her BETs in the normal games are rewarded.

Further, even in a case where the amount of BET placed in each normal game is uneven, the amount of the game media to be paid out in the free game is determined based upon the average value of those amounts of BET. Accordingly, it is possible to give the player an impression of being fair.

Furthermore, the more game media the player bets in the normal games, the more game media the player may acquire in the free game. Accordingly, it is possible to encourage the player to bet a lot of game media, so as to be able to aim the increase in the profit of the recreation facility.

The present invention further provides a slot machine having the following configuration.

Namely, the slot machine comprises: a BET input device capable of receiving an input of a BET; a symbol display capable of variably displaying a plurality of symbols; and a controller. The controller is programmed to execute processing of: (A) receiving an input of a BET through the BET input device; (B) executing a normal game in which the plurality of symbols are variably displayed and then stop-displayed to the symbol display after the input of the BET in the processing (A), an amount of payout is determined based upon a stop-displayed symbol or a combination of stop-displayed symbols and an amount of the game media betted in the processing (A), and game media of the determined amount of payout are paid out; (C) shifting a mode from a non-insurance mode to an insurance mode, on condition that a predetermined number of game media are inserted; (D) calculating an amount of game media, which is obtained by dividing a total amount of the game media betted in the processing (A) executed in said insurance mode by the number of BETs; and (E) executing an insured free game when a predetermined condition is satisfied in the insurance mode, the insured free game being a game in which the plurality of symbols are variably displayed and then stop-displayed to the symbol display even without a BET of game media, the amount of payout is determined based upon a stop-displayed symbol or a combination of stop-displayed symbols and the amount of game media calculated in the processing (D), and game media of the determined amount of payout are paid out.

According to the above-mentioned slot machine, the insured free game is executed when a predetermined condition is satisfied. In the insured free game, the amount of payout is determined based upon the amount of the game media obtained by dividing the total amount of the game media betted in the normal games by the number of BETs. Namely, the amount of payout is determined based upon an average value of the amount of the game media betted in the normal games (hereinafter, also referred to as an average value of the amount of BET). Then, game media of the determined amount of payout are paid out. Namely, the amount of the game media to be paid out in the insured free game is determined based upon the average value of the amount of the game media betted in the normal games.

The average value of the amount of the game media betted in the normal games represents the amount invested by the player in the normal games, and is a symbol for the player, which represents his or her effort made until the insured free game is generated.

According to the above-mentioned slot machine, the amount of the game media to be paid out in the insured free game is determined based upon this kind of value, and therefore, it is possible to provide the player with a certain sense of achievement in that his or her BETs in the normal games are rewarded.

Further, even in a case where the amount of BET placed in each normal game is uneven, the amount of the game media to be paid out in the insured free game is determined based upon the average value of those amounts of BET. Accordingly, it is possible to give the player an impression of being fair.

Furthermore, the more game media the player bets in the normal games, the more game media the player may acquire in the insured free game. Accordingly, it is possible to encourage the player to bet a lot of game media, so as to be able to aim the increase in the profit of the recreation facility.

Further, according to the above-mentioned slot machine, the mode is shifted from the non-insurance mode to the insurance mode, on condition that a predetermined number of game media are inserted. The amount of game media to be paid out in the insured free game is determined based upon the average value of the amount of game media betted in the normal games played in the insurance mode.

Accordingly, by determining timing to shift the mode to the insurance mode, the player can determine the timing when normal games start to be subject to calculation of the average value of the amount of BET by his or her own choice.

Among the players playing a game on a slot machine, there is a player who plays a game by betting a small amount of game media at the start of the game to see what that slot machine is like, and increases the amount of game media to bet after finding out what that slot machine is like. According to the above-mentioned slot machine, it is possible to have the player determine the timing to shift the mode to the insurance mode after finding out what that slot machine is like. Namely, the normal game at the start, in which the player bets only a small amount of game media, is not subject to calculation of the average value of the amount of BET, and therefore, it is possible to provide such player with a feeling of satisfaction.

It is desirable that the slot machine further has the following configuration.

Namely, the controller is further programmed to execute the processing of (F) counting the number of the normal games executed in the processing (B) in the insurance mode. Further, the processing (E) comprises executing the insured free game when the number counted in the processing (F) has reached a prescribed number, the insured free game being a game in which the plurality of symbols are variably displayed and then stop-displayed to the symbol display even without a BET of game media, the amount of payout is determined based upon a stop-displayed symbol or a combination of stop-displayed symbols and the amount of game media calculated in the processing (D), and game media of the determined amount of payout are paid out.

According to the above-mentioned slot machine, the number of normal games is counted, and the insured free game is generated when the number of counted normal games has reached the prescribed number (e.g. 1000).

Accordingly, the insured free game may be generated after the normal games are played for a comparatively long time. Further, it is highly possible that the player has a special feeling for the average value of the amount of BET in that the player has placed BETs repeatedly for a long time. According to the above-mentioned slot machine, the amount of the game media to be paid out in the insured free game is determined based upon this kind of average value of the amount of BET, and therefore, it is possible to enhance the player's sense of achievement that his or her BETs in the normal games are rewarded.

It is desirable that the slot machine further has the following configuration.

Namely, the controller is further programmed to execute the processing of (G) executing an uninsured free game when a specific condition different from the predetermined condition is satisfied in the normal game executed in the non-insurance mode, the uninsured free game being a game in which the plurality of symbols are variably displayed and then stop-displayed to the symbol display even without a BET of game media, an amount of payout is determined based upon a stop-displayed symbol or a combination of stop-displayed symbols and the amount of game media betted in the normal game in which the specific condition has been satisfied, and game media of the determined amount of payout are paid out.

According to the above-mentioned slot machine, the uninsured free game is executed when a specific condition is satisfied in the normal game conducted in the non-insurance mode. The amount of the game media to be paid out in the uninsured free game is determined based upon the amount of the game media betted in the normal game in which the specific condition has been satisfied.

Accordingly, if a lot of game media had been betted in the normal game in which the specific condition has been satisfied, the player may acquire a lot of game media in the uninsured free game, even the amount of the game media betted in the previous normal game is small. Thus, it is possible to provide such player with a feeling of satisfaction. Further, it is possible to provide a high-risk-high-return game in that regard.

Generally, among the players playing a game on a slot machine, there are a player who prefers a high-risk-high-return game and a player who prefers a game ensuring the fairness. According to the above-mentioned slot machine, it is possible to have the player play a game of his or her choice by selecting whether or not to shift the mode to the insurance mode.

It is desirable that the slot machine further has the following configuration.

Namely, the processing (B) comprises: (B-1) executing in the non-insurance mode an uninsured normal game in which the plurality of symbols are variably displayed and then stop-displayed to the symbol display after the input of the BET in the processing (A), the amount of payout is determined based upon a symbol stop-displayed on a predetermined number of pay lines set on the symbol display or a combination of stop-displayed symbols and the amount of the game media betted in the processing (A), and game media of the determined amount of payout are paid out; and (B-2) executing in the insurance mode an insured normal game in which the plurality of symbols are variably displayed and then stop-displayed to the symbol display after the input of the BET in the processing (A), the amount of payout is determined based upon a symbol stop-displayed on a specific number of pay lines set on the symbol display or a combination of stop-displayed symbols and the amount of the game media betted in the processing (A), the specific number being larger than the predetermined number, and game media of the determined amount of payout are paid out.

According to the above-mentioned slot machine, the number of pay lines is larger in the insured normal game conducted in the insurance mode than in the uninsured normal game conducted in the non-insurance mode. Namely, the player can increase the number of pay lines by shifting the mode to the insurance mode.

Accordingly, it is possible to encourage the player who is not sure whether or not to shift the mode to the insurance mode, to shift the mode to the insurance mode. Accordingly, it becomes possible to have more players to play the insured free game and to provide the player with the feeling of satisfaction that his or her BETs in the normal games are rewarded.

The present invention further provides a control method of a slot machine, the control method having the following configuration.

Namely, the control method of a slot machine comprises steps of: (A) receiving an input of a BET from a BET input device; (B) executing a normal game in which a plurality of symbols are variably displayed and then stop-displayed to a symbol display after the input of the BET in the step (A), an amount of payout is determined based upon a stop-displayed symbol or a combination of stop-displayed symbols and an amount of the game media betted in the step (A), and game media of the determined amount of payout are paid out; (C) calculating an amount of game media, which is obtained by dividing a total amount of the game media betted in the step (A) by the number of BETs; and (D) executing a free game when a predetermined condition is satisfied, the free game being a game in which the plurality of symbols are variably displayed and then stop-displayed to the symbol display even without a BET of game media, the amount of payout is determined based upon a stop-displayed symbol or a combination of stop-displayed symbols and the amount of game media calculated in the step (C), and game media of the determined amount of payout are paid out.

According to the above-mentioned control method of a slot machine, the free game is executed when a predetermined condition is satisfied. In the free game, the amount of payout is determined based upon the amount of the game media obtained by dividing the total amount of the game media betted in the normal games by the number of BETs. Namely, the amount of payout is determined based upon an average value of the amount of the game media betted in the normal games (hereinafter, also referred to as an average value of the amount of BET). Then, game media of the determined amount of payout are paid out. Namely, the amount of the game media to be paid out in the free game is determined based upon the average value of the amount of the game media betted in the normal games.

The average value of the amount of the game media betted in the normal games represents the amount invested by the player in the normal games, and is a symbol for the player, which represents his or her effort made until the free game is generated.

According to the above-mentioned slot machine, the amount of the game media to be paid out in the free game is determined based upon this kind of value, and therefore, it is possible to provide the player with a certain sense of achievement in that his or her BETs in the normal games are rewarded.

Further, even in a case where the amount of BET placed in each normal game is uneven, the amount of the game media to be paid out in the free game is determined based upon the average value of those amounts of BET. Accordingly, it is possible to give the player an impression of being fair.

Furthermore, the more game media the player bets in the normal games, the more game media the player may acquire in the free game. Accordingly, it is possible to encourage the player to bet a lot of game media, so as to be able to aim the increase in the profit of the recreation facility.

The present invention further provides a control method of a slot machine, having the following configuration.

Namely, the control method of a slot machine comprises steps of: (A) receiving an input of a BET from a BET input device; (B) executing a normal game in which a plurality of symbols are variably displayed and then stop-displayed to a symbol display after the input of the BET in the step (A), an amount of payout is determined based upon a stop-displayed symbol or a combination of stop-displayed symbols and an amount of the game media betted in the step (A), and game media of the determined amount of payout are paid out; (C) shifting a mode from a non-insurance mode to an insurance mode, on condition that a predetermined number of game media are inserted; (D) calculating an amount of game media, which is obtained by dividing a total amount of the game media betted in the step (A) executed in said insurance mode by the number of BETs; and (E) executing an insured free game when a predetermined condition is satisfied in the insurance mode, the insured free game being a game in which the plurality of symbols are variably displayed and then stop-displayed to the symbol display even without a BET of game media, the amount of payout is determined based upon a stop-displayed symbol or a combination of stop-displayed symbols and the amount of game media calculated in the step (D), and game media of the determined amount of payout are paid out.

According to the above-mentioned control method of a slot machine, the insured free game is executed when a predetermined condition is satisfied. In the insured free game, the amount of payout is determined based upon the amount of the game media obtained by dividing the total amount of the game media betted in the normal games by the number of BETs. Namely, the amount of payout is determined based upon an average value of the amount of the game media betted in the normal games (hereinafter, also referred to as an average value of the amount of BET). Then, game media of the determined amount of payout are paid out. Namely, the amount of the game media to be paid out in the insured free game is determined based upon the average value of the amount of the game media betted in the normal games.

The average value of the amount of the game media betted in the normal games represents the amount invested by the player in the normal games, and is a symbol for the player, which represents his or her effort made until the insured free game is generated.

According to the above-mentioned slot machine, the amount of the game media to be paid out in the insured free game is determined based upon this kind of value, and therefore, it is possible to provide the player with a certain sense of achievement in that his or her BETs in the normal games are rewarded.

Further, even in a case where the amount of BET placed in each normal game is uneven, the amount of the game media to be paid out in the insured free game is determined based upon the average value of those amounts of BET. Accordingly, it is possible to give the player an impression of being fair.

Furthermore, the more game media the player bets in the normal games, the more game media the player may acquire in the insured free game. Accordingly, it is possible to encourage the player to bet a lot of game media, so as to be able to aim the increase in the profit of the recreation facility.

Further, according to the above-mentioned control method of a slot machine, the mode is shifted from the non-insurance mode to the insurance mode, on condition that a predetermined number of game media are inserted. The amount of game media to be paid out in the insured free game is determined based upon the average value of the amount of game media betted in the normal games played in the insurance mode.

Accordingly, by determining timing to shift the mode to the insurance mode, the player can determine the timing when normal games start to be subject to calculation of the average value of the amount of BET by his or her own choice.

Among the players playing a game on a slot machine, there is a player who plays a game by betting a small amount of game media at the start of the game to see what that slot machine is like, and increases the amount of game media to bet after finding out what that slot machine is like. According to the above-mentioned slot machine, it is possible to have the player determine the timing to shift the mode to the insurance mode after finding out what that slot machine is like. Namely, the normal game at the start, in which the player bets only a small amount of game media, is not subject to calculation of the average value of the amount of BET, and therefore, it is possible to provide such player with a feeling of satisfaction.

BRIEF DESCRIPTIONS OF THE DRAWINGS

FIG. 5 is a symbol table for a normal game, which shows a correspondence relationship among each symbol in each symbol array of display blocks, a code number and a random number value.

FIG. 7 is a view showing a correspondence relationship among a kind and the number of symbols rearranged on a pay line, and an amount of payout.

FIG. 15 is a view showing a table for determining the number of to-be-added special symbols.

FIG. 17 is a view showing a symbol-array determination table.

FIG. 18 is a view showing a code-number determination table.

FIG. 19A is an example of a symbol table for a feature game, which shows a correspondence relationship among each symbol in each symbol array of the display blocks, the code number and the random number value.

FIG. 19B is an example of a symbol table for a feature game, which shows a correspondence relationship among each symbol in each symbol array of the display blocks, the code number and the random number value.

DESCRIPTION OF THE EMBODIMENTS

A present embodiment is described by using FIGS. 1A to 1D.

FIGS. 1A to 1D are views each showing an exemplary image displayed to a lower image display panel.

In a slot machine 10 (cf. FIG. 2) according to the present embodiment, while a first free game is conducted when a specific condition is satisfied, a second free game is conducted when a predetermined condition is satisfied. The first free game and the second free game are both referred to as free games. The free game is a game that can be played without betting game media such as a coin. Here, among games conducted in the slot machine 10, the game other than the free game is referred to as a normal game in the present specification.

Figure 1A:
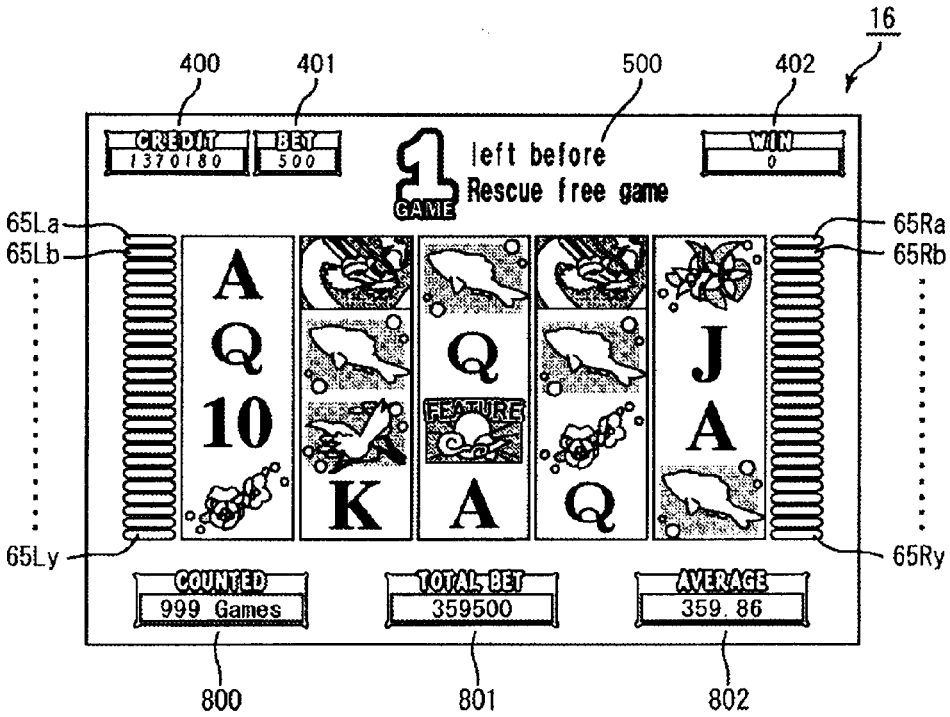
FIG. 1A is a view showing an exemplary image displayed to a lower image display panel provided in a slot machine according to one embodiment of the present invention.
Figure 1B:
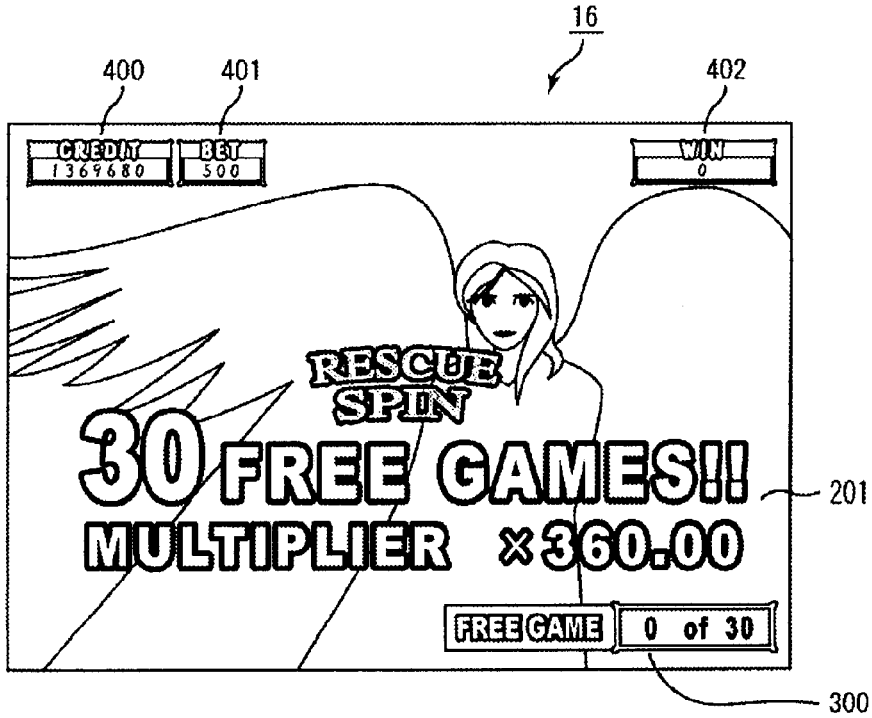
FIG. 1B is a view illustrating an exemplary image displayed to a lower image display panel provided in a slot machine according to one embodiment of the present invention.

FIGS. 1A and 1B are views for explaining the second free game.

Figure 1C:
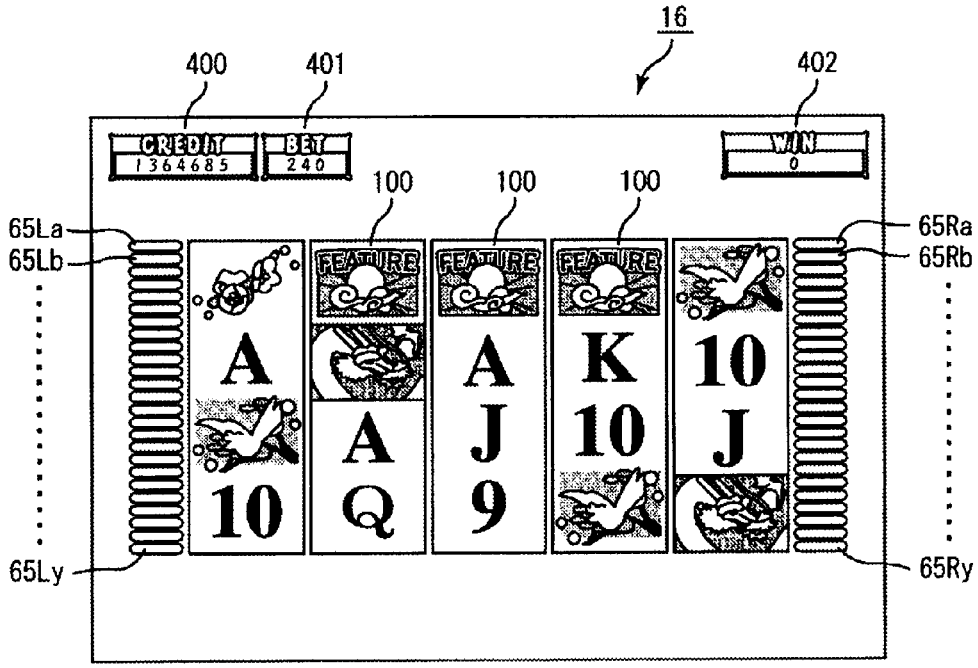
FIG. 1C is a view showing an exemplary image displayed to a lower image display panel provided in a slot machine according to one embodiment of the present invention.
Figure 1D:
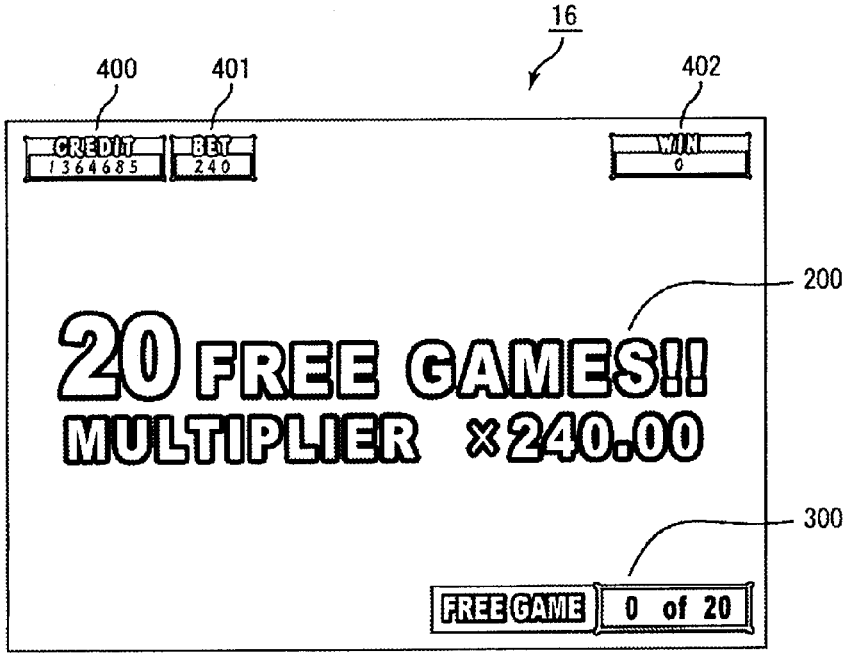
FIG. 1D is a view showing an exemplary image displayed to a lower image display panel provided in a slot machine according to one embodiment of the present invention.

FIGS. 1C and 1D are views for explaining the first free game.

In the following, there is described the second free game first.

In the slot machine 10 according to the present embodiment, a mode is shifted from a non-insurance mode to an insurance mode triggered by an insurance BET button 90 (cf. FIG. 2) being pressed. Then, the number of normal games conducted after the shift of the mode to the insurance mode is counted. When the number of the counted normal games (hereinafter, also referred to as the number of the with-insurance games) has reached a prescribed number (1000), the second free game is generated. The number of the with-insurance games reaching the prescribed number corresponds to a predetermined condition in the present invention.

Figure 2:
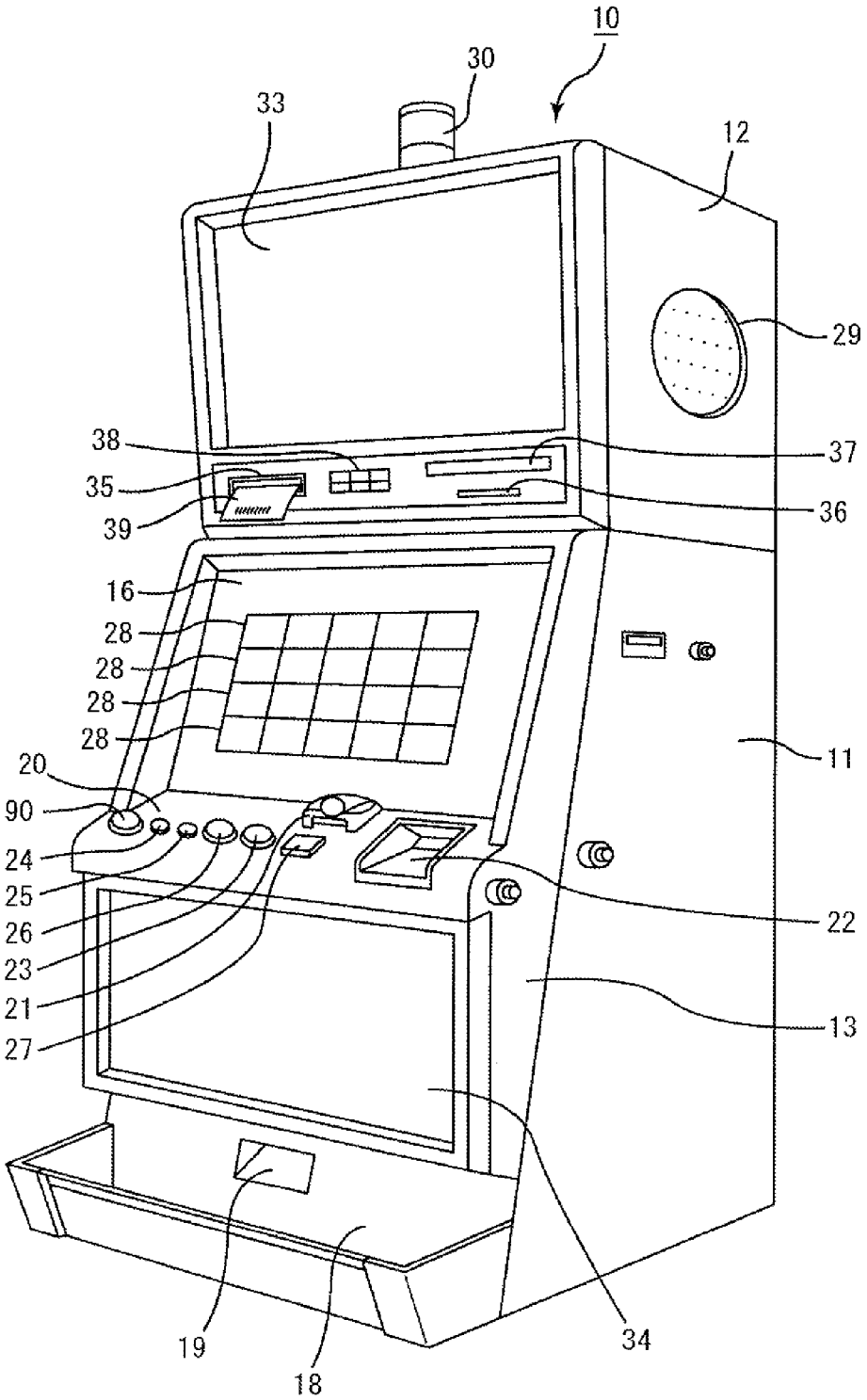
FIG. 2 is a perspective view showing an external view of a slot machine according to one embodiment of the present invention.

As shown in FIG. 1A, a countdown image 500 is displayed to a lower image display panel 16 (cf. FIG. 2). The countdown image 500 is an image showing the number of the games until the number of the with-insurance games reaches the prescribed number (1000). The example in FIG. 1A shows that one game is left before the number of the with-insurance games reaches the prescribed number (1000).

Further, FIG. 1A also shows a state where a display portion 800 of the number of the with-insurance games, a cumulative-number-of-BETs display portion 801, and an average-number-of-BETs display portion 802 are displayed to the lower image display panel 16.

The display portion 800 of the number of the with-insurance games shows the number of the with-insurance games.

The cumulative-number-of-BETs display portion 801 shows a cumulative number of BETs. The cumulative number of BETs is a total number of coins betted in the normal game conducted after the mode was shifted to the insurance mode.

The average-number-of-BETs display portion 802 shows an average number of BETs. The average number of BETs is the number obtained by dividing the cumulative number of BETs by the number of the with-insurance games.

In the example shown in FIG. 1A, the number of the with-insurance games is 999, the cumulative number of BETs is 359500, and the average number of BETs is 359.86 (≅359500÷999).

In FIG. 1B, a state that a reaching effect image 201 is displayed triggered by the number of the with-insurance games having reached the prescribed number (1000) is shown. The reaching effect image 201 shows that 30 second free games are generated triggered by the number of the with-insurance games having reached the prescribed number.

The reaching effect image 201 shows that a free-game multiplier is "360". The free-game multiplier is N which satisfies N≤(average number of BETs)<N+1. In the free game, an amount of payout is determined assuming that coins in number corresponding to the free-game multiplier (360, in the example shown in FIG. 1B) are betted. For example, when a prize which pays out 8 coins in the case that 1 coin is betted is established in the free game, the amount of payout is determined to be 2880 (=8×360) coins.

As above, the second free game has been described by using FIG. 1A and FIG. 1B.

Subsequently, the first free game is described by using FIG. 1A and FIG. 1D.

In the slot machine 10 according to the present embodiment, a plurality of symbols are variably displayed and then stop-displayed (rearranged) in display blocks 28 in the lower image display panel 16.

In FIG. 1C, a state that three feature symbols 100 are stop-displayed is shown. In the present embodiment, the first free game is generated when three or more feature symbols 100 are stop-displayed in the normal game. The stop-display of three or more feature symbols 100 in the normal game corresponds to the specific condition in the present invention.

In FIG. 1D, a state that a free-game-generated image 200 is displayed triggered by three feature symbols 100 being stop-displayed. The free-game-generated image 200 shows that 20 first free games are generated triggered by the stop-display of three feature symbols 100.

Further, the free-game-generated image 200 also shows the free-game multiplier.

A method for determining the free-game multiplier in the first free game is varied in accordance with whether the mode is the non-insurance mode or the insurance mode.

In a case where the mode is the non-insurance mode when three or more feature symbols 100 are stop-displayed, the number of coins betted in the normal game in which three or more feature symbols have been stop-displayed is determined as the free-game multiplier. In the example shown in FIG. 10, it is shown that the free-game multiplier is "240" because the number of the coins betted in the normal game in which three feature symbols 100 have been stop-displayed is 240.

In a case where the mode is the insurance mode when three or more feature symbols 100 are stop-displayed, the free-game multiplier is N which satisfies N≤(average number of BETs)<N+1.

As above, the general description of the present embodiment has been given by using FIGS. 1A to 1D.

It is to be noted that the free game is also referred to as a feature game in the following.

Further, each of FIGS. 1A to 1D also shows a state that a number-of-credits display portion 400, a number-of-BETs display portion 401 and a number-of-payouts display portion 402 are displayed to the lower image display panel 16. The number-of-credits display portion 400 is for displaying the number of credited coins. The number-of-BETs display portion 401 is for displaying the number of betted coins. The number-of-payouts display portion 402 is for displaying the number of coins to be paid out.

Further, each of FIG. 1B and FIG. 1D also shows a state where a number-of-free-games display portion 300 is provided on the lower image display panel 16. To the number-of-free-games display portion, the number of generated free games (hereinafter, also referred to as the number of all free games) and the number of already conducted free games (hereinafter, also referred to as number the number of the conducted free games) are displayed. The example in FIG. 1B shows that the number of all free games is 30 and the number of the conducted free games is 0.

In the following, the present embodiment is described in more detail.

FIG. 2 is a perspective view showing an external view of a slot machine according to one embodiment of the present invention.

In the slot machine 10, a coin, a bill, or electronic valuable information corresponding to those is used as a game medium. However, in the present invention, the game medium is not particularly limited. Examples of the game medium may include a medal, a token, electronic money and a ticket. It is to be noted that the ticket is not particularly limited, and examples thereof may include a ticket with a barcode as described later.

The slot machine 10 comprises a cabinet 11, a top box 12 installed on the upper side of the cabinet 11, and a main door 13 provided at the front face of the cabinet 11.

On the main door 13, there is provided the lower image display panel 16. The lower image display panel 16 includes a transparent liquid crystal panel which displays twenty display blocks 28 along five columns and four rows. A single symbol is displayed in each display block 28. The lower image display panel 16 corresponds to the symbol display in the present invention.

Here, in the present embodiment, a case is described where the slot machine 10 is a so-called video slot machine. However, a slot machine of the present invention may be configured to stop-display the symbols by using a so-called mechanical reel.

Further, although not shown, various types of images relating to an effect, in addition to the aforementioned images, are displayed to the lower image display panel 16.

Moreover, although not shown, the touch panel 69 is provided at the front face of the lower image display panel 16. The player can operate the touch panel 69 to input a variety of commands.

When the touch panel 69 is operated, an input signal is transmitted from the touch panel 69 to a main CPU 41.

Below the lower image display panel 16, there are provided a control panel 20 including a plurality of buttons 23 to 27 and 90, with each of which a command according to game progress is inputted by the player, a coin receiving slot 21 through which a coin is accepted into the cabinet 11, and a bill validator 22.

The control panel 20 is provided with a start button 23, a change button 24, a CASHOUT button 25, a 1-BET button 26, a maximum BET button 27, and an insurance BET button 90. The start button 23 is for inputting a command to start scrolling of symbols. The change button 24 is used for making a request of staff in the recreation facility for exchange. The CASHOUT button 25 is used for inputting a command to pay out credited coins to a coin tray 18.

The 1-BET button 26 is used for inputting a command to bet one coin on a game out of credited coins. The maximum BET button 27 is used for inputting a command to bet the maximum number of coins that can be bet on one game (500 coins in the present embodiment) out of credited coins. The insurance BET button 90 is used for inputting a command to shift the mode from the non-insurance mode to the insurance mode.

The 1-BET button 26 and the maximum BET button 27 constitute the BET input device of the present invention.

It is to be noted that the BET input device of the present invention is not limited to the button. For example, the BET input device of the present invention may be a touch panel.

The bill validator 22 not only discriminates a regular bill from a false bill, but also accepts the regular bill into the cabinet 11. It is to be noted that the bill validator 22 may be configured so as to be capable of reading a later-described ticket 39 with a barcode. At the lower front of the main door 13, namely, below the control panel 20, there is provided a belly glass 34 on which a character or the like of the slot machine 10 is drawn.

An upper image, display panel 33 is provided on the front surface of the top box 12. The upper image display panel 33 is provided with a liquid crystal panel and displays, for example, images indicative of introduction of contents of the game and explanation of the rule of the game.

Further, a speaker 29 is provided in the top box 12. Under the upper image display panel 33, there are provided a ticket printer 35, a card reader 36, a data display 37, and a key pad 38. The ticket printer 35 prints on a ticket a barcode as coded data of the number of credits, a date, an identification number of the slot machine 10, and the like, and outputs the ticket as the ticket 39 with a barcode. The player can make another slot machine read the ticket 39 with a barcode to play a game thereon, or exchange the ticket 39 with a barcode with a bill or the like at a predetermined place in the recreation facility (e.g. a cashier in a casino).

The card reader 36 reads data from a smart card and writes data into the smart card. The smart card is a card owned by the player, and for example, data for identifying the player and data concerning a history of games played by the player are stored therein. Data corresponding to a coin, a bill or a credit may be stored in the smart card. Further, a magnetic stripe card may be adopted in place of the smart card. The data display 37 includes a fluorescent display and the like, and displays, for example, data read by the card reader 36 or data inputted by the player via the key pad 38. The key pad 38 is used for inputting a command and data concerning issuing of a ticket, and the like.

Figure 3:
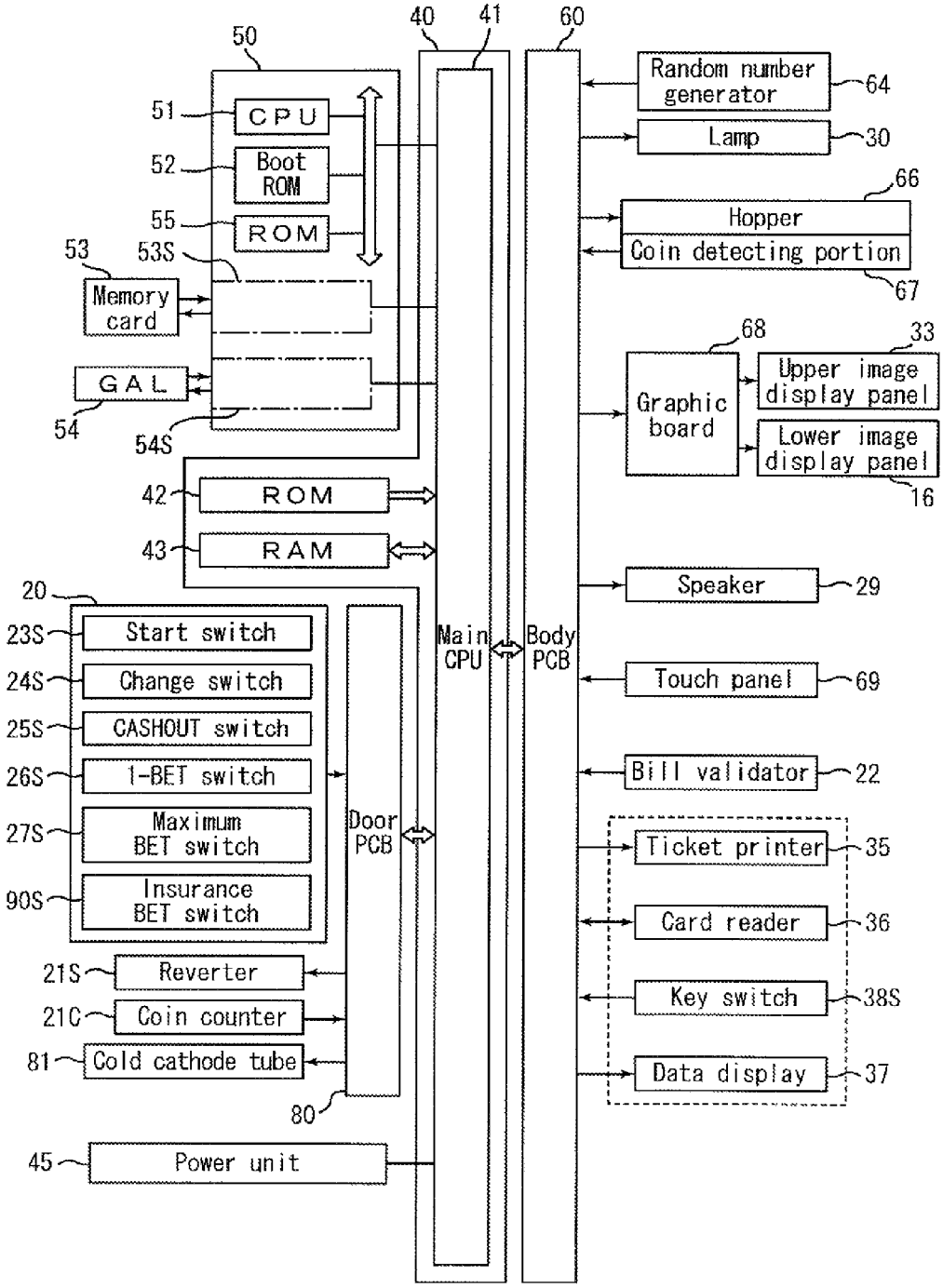
FIG. 3 is a block diagram showing an internal configuration of the slot machine shown in FIG. 2.

FIG. 3 is a block diagram showing an internal configuration of the slot machine shown in FIG. 2.

A gaming board 50 is provided with a CPU (Central Processing Unit) 51, a ROM 55, and a boot ROM 52 which are interconnected to one another by an internal bus, a card slot 53S corresponding to a memory card 53, and an IC socket 54S corresponding to a GAL (Generic Array Logic) 54.

The memory card 53 includes a nonvolatile memory such as CompactFlash (registered trademark), and stores a game program. The game program includes a symbol determination program. The symbol determination program is a program for determining symbols to be rearranged in the display blocks 28.

Further, the card slot 53S is configured so as to allow the memory card 53 to be inserted thereinto or removed therefrom, and is connected to the mother board 40 by an IDE bus. Therefore, the memory card 53 can be removed from the card slot 53S, and then another game program is written into the memory card 53, and the memory card 53 can be inserted into the card slot 53S, to change the type and contents of the game played on the slot machine 10. The game program includes a program according to progress of the game. Further, the game program includes image data and sound data to be outputted during the game. The image data includes image data indicative of the free-game-generated image 200, the reaching effect image 201, and the like.

Further, the game program includes: symbol-table data for a normal game, showing a symbol table for a normal game (cf. FIG. 5) which shows the correspondence relationship among each symbol in each symbol array of the display blocks, the code number and the random number value; odds data showing the correspondence relationship (cf. FIG. 7) among the kind and the number of the symbols rearranged on a pay line 300 (cf. FIG. 6) and the amount of payout; determination table data of the number of the to-be-added special symbols which shows a table (cf. FIG. 15) for determining the number of the to-be-added special symbols; symbol-array determination table data showing a symbol-array determination table (cf. FIG. 17); and code-number determination-table data showing a code-number determination table (cf. FIG. 18), and the like.

The CPU 51, the ROM 55 and the boot ROM 52 interconnected to one another by an internal bus are connected to the mother board 40 through the PCI bus. The PCI bus not only conducts signal transmission between the mother board 40 and the gaming board 50, but also supplies power from the mother board 40 to the gaming board 50.

The mother board 40 is configured using a commercially available general-purpose mother board (a print wiring board on which fundamental components of a personal computer are mounted), and provided with the main CPU 41, a ROM (Read Only Memory) 42, and a RAM (Random Access Memory) 43. The mother board 40 corresponds to the controller in the present invention.

The ROM 42 comprises a memory device such as a flash memory, and stores a program such as a BIOS (Basic Input/Output System) executed by the main CPU 41 and permanent data. When the BIOS is executed by the main CPU 41, processing for initializing a predetermined peripheral device is conducted, concurrently with start of processing for loading the game program stored in the memory card 53 via the gaming board 50. It is to be noted that, in the present invention, the ROM 42 may or may not be data rewritable one.

The RAM 43 stores data and a program such as a symbol-determination program, which are used at the time of operation of the main CPU 41. Further, the RAM 43 is capable of storing a game program.

Moreover, the RAM 43 stores data of the number of credits, the numbers of coin-ins and coin-outs in one game, and the like. Further, the RAM 43 stores symbol-table data for a feature game, showing a symbol table for a feature game (cf. FIGS. 17A and 17B) which shows the correspondence relationship among each symbol in each symbol array of the display blocks, the code number and the random number value, and the like.

Further, the RAM 43 is provided with a storage area of the number of the with-insurance games, a cumulative-number-of-BETs storage area, an average-number-of-BETS storage area, a free-game-multiplier storage area, and a number-of-free-games storage area.

The storage area of the number of the with-insurance games stores data on the number of the with-insurance games indicative of a number C of the with-insurance games.

The cumulative-number-of-BETs storage area stores cumulative-number-of-BETs data indicative of the cumulative number of BETs.

The average-number-of-BETS storage area stores average-number-of-BETs data indicative of the average number of BETS.

The free-game-multiplier storage area stores free-game-multiplier data indicative of the free-game multiplier.

The number-of-free-games storage area stores remaining-number data indicative of a remaining number T of the free games.

Further, a storage area of an insurance flag is provided in the main RAM 43. The insurance flag is a flag to be set triggered by the insurance BET button 90 being pressed. The storage area of the insurance flag comprises, for example, a storage area of a predetermined number of bits, and the insurance flag is turned "ON" or "OFF" in accordance with a storage in the storage area. The state of "ON" of the insurance flag corresponds to the insurance mode. The state of "OFF" of the insurance flag corresponds to the non-insurance mode.

Moreover, the mother board 40 is connected with a later-described body PCB (Printed Circuit Board) 60 and a door PCB 80 through respective USBs. Further, the mother board 40 is connected with a power supply unit 45.

The body PCB 60 and the door PCB 80 are connected with equipment and a device that generate an input signal to be inputted into the main CPU 41, and equipment and a device operations of which are controlled by a control signal outputted from the main CPU 41. The main CPU 41 executes the game program stored in the RAM 43 based upon the input signal inputted into the main CPU 41, and thereby executes the predetermined arithmetic processing and stores the result thereof into the RAM 43, or transmits a control signal to each equipment and device as processing for controlling each equipment and device.

The body PCB 60 is connected with a lamp 30, a hopper 66, a coin detecting portion 67, a graphic board 68, the speaker 29, the touch panel 69, the bill validator 22, the ticket printer 35, the card reader 36, a key switch 38S, the data display 37, and a random number generator 64. The lamp 30 is lighted in a predetermined pattern based upon control signals outputted from the main CPU 41.

The hopper 66 is installed inside the cabinet 11, and pays out a predetermined number of coins based upon the control signal outputted from the main CPU 41, from a coin payout exit 19 to the coin tray 18. The coin detecting portion 67 is provided inside the coin payout exit 19, and outputs an input signal to the main CPU 41 in the case of detecting payout of the predetermined number of coins from the coin payout exit 19.

The graphic board 68 controls image display to the upper image display panel 33 and the lower image display panel 16 based upon the control signal outputted from the main CPU 41. In the respective display blocks 28 on the lower image display panel 16, symbols are displayed in a scrolling manner or in a stopped state. The number of credits stored in the RAM 43 is displayed to the number-of-credits display portion 400 of the lower image display panel 16. Further, the number of betted coins is displayed to the number-of-bets display portion 401 of the lower image display panel 16. Furthermore, the number of coin-outs is displayed to the payout display portion 402 of the lower image display panel 16.

The graphic board 68 comprises a VDP (Video Display Processor) for generating image data based upon the control signal outputted from the main CPU 41, a video RAM for temporarily storing image data generated by the VDP, and the like. It is to be noted that image data used in generation of the image data by the VDP is included in the game program read from the memory card 53 and stored into the RAM 43.

The bill validator 22 not only discriminates a regular bill from a false bill, but also accepts the regular bill into the cabinet 11. Upon acceptance of the regular bill, the bill validator 22 outputs an input signal to the main CPU 41 based upon a face amount of the bill. The main CPU 41 stores in the RAM 43 the number of credits corresponding to the face amount of the bill transmitted with the input signal.

The ticket printer 35 prints on a ticket a barcode as coded data of the number of credits stored in the RAM 43, a date, and an identification number of the slot machine 10, and the like, based upon the control signal outputted from the main CPU 41, and outputs the ticket as the ticket 39 with a barcode. The card reader 36 reads data from the smart card and transmits the read data to the main CPU 41, and writes data onto the smart card based upon the control signal from the main CPU 41. The key switch 38S is provided on the key pad 38, and outputs a predetermined input signal to the main CPU 41 when the key pad 38 is operated by the player. The data display 37 displays data read by the card reader 36 and data inputted by the player via the key pad 38, based upon the control signal outputted from the main CPU 41.

The random number generator 64 generates a random number at a predetermined timing. It is to be noted that the range of the random number generated by the random number generator 64 is from 0 to 65535.

The door PCB 80 is connected with the control panel 20, a reverter 21S, a coin counter 21C, and a cold cathode tube 81. The control panel 20 is provided with a start switch 23S corresponding to the start button 23, a change switch 24S corresponding to the change button 24, a CASHOUT switch 25S corresponding to the CASHOUT button 25, a 1-BET switch 26S corresponding to the 1-BET button 26, a maximum BET switch 27S corresponding to the maximum BET button 27, and an insurance BET switch 90S corresponding to the insurance BET button 90. Each of the switches 23S to 27S and 90S outputs an input signal to the main CPU 41 when each of the buttons 23 to 27 and 90 corresponding thereto is operated by the player.

The coin counter 21C is provided inside the coin receiving slot 21, and discriminates a regular coin from a false coin inserted into the coin receiving slot 21 by the player. Coins other than the regular coin are discharged from the coin payout exit 19. Further, the coin counter 21C outputs an input signal to the main CPU 41 in detection of the regular coin.

The reverter 21S operates based upon the control signal outputted from the main CPU 41, and distributes a coin recognized by the coin counter 21C as the regular coin into a cash box not shown) or the hopper 66, which are disposed in the slot machine 10. Namely, when the hopper 66 is filled with coins, the regular coin is distributed into the cash box by the reverter 21S. On the other hand, when the hopper 66 is not filled with coins, the regular coin is distributed into the hopper 66. The cold cathode tube 81 functions as a back light installed on the rear face side of the lower image display panel 16 and the upper image display panel 33, and lighted up based upon the control signal outputted from the main CPU 41.

Figure 4:
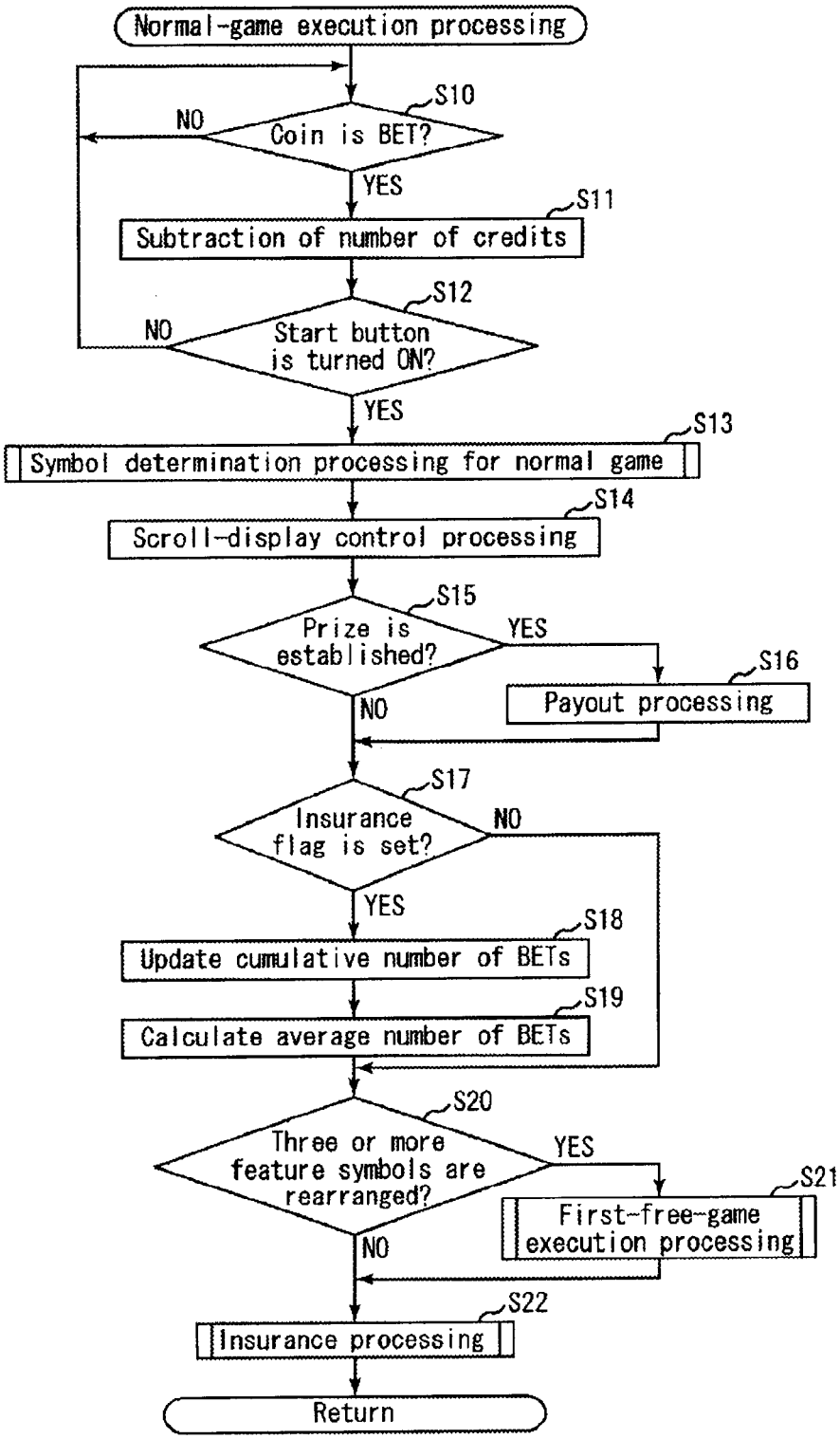
FIG. 4 is a flowchart showing normal-game execution processing.

FIG. 4 is a flowchart illustrating normal-game execution processing.

First, the main CPU 41 determines whether or not a coin has been betted (step S10). In this processing, the main CPU 41 determines whether or not to have received an input signal that is outputted from the 1-BET switch 26S when the 1-BET button 26 is operated, or an input signal that is outputted from the maximum BET switch 27S when the maximum BET button 27 is operated. When the main CPU 41 determines that the coin has not been betted, the processing is returned to step S10.

On the other hand, when determining that the coin has been betted in step S10, the main CPU 41 conducts processing for making a subtraction from the number of credits stored in the RAM 43 according to the number of betted coins (step S11). It is to be noted that, when the number of coins to be betted is larger than the number of credits stored in the RAM 43, the main CPU 41 does not conduct the processing for making a subtraction from the number of credits stored in the RAM 43, and the processing is returned to step S10. Further, when the number of coins to be betted exceeds the upper limit of the number of coins that can be betted in one game (500 coins in the present embodiment), the main CPU 41 does not conduct the processing for making a subtraction from the number of credits stored in the RAM 43, and the processing is proceeded to step S12.

Next, the main CPU 41 determines whether or not the start button 23 has been turned ON (step S12). In this processing, the main CPU 41 determines whether or not to have received an input signal that is outputted from the start switch 23S when the start button 23 is pressed.

When the main CPU 41 determines that the start button 23 has not been turned on, the processing is returned to step S10.

It is to be noted that, when the start button 23 is not turned ON (e.g. when the start button 23 is not turned ON and a command to end the game is inputted), the main CPU 41 cancels a subtraction result in step S11.

On the other hand, when determining in step S12 that the start button 23 is turned ON, the main CPU 41 executes the symbol determination processing for the normal game (step S13).

FIG. 5 is the symbol table for the normal game which shows the correspondence relationship among each symbol in each symbol array of the display blocks, the code number and the random number value. It is to be noted that the first array corresponds to the leftmost column of the display blocks 28.

In the symbol determination processing for the normal game, the main CPU 41 executes the symbol determination program stored in the RAM 43 to determine the code numbers at stopping the symbols. Specifically, random number values are acquired, and the code numbers at stopping the symbols in each symbol array of the display blocks 28 is determined, based upon the acquired random number values and the symbol table for the normal game. The symbol determination program for the normal game is later described in detail using the drawing.

As shown in FIG. 5, 14 wild symbols (also referred to as special symbols) are present in the symbol table for the normal game. The wild symbol is a symbol which can be substituted for another symbol.

Next, in step S14, the main CPU 41 performs scroll-display control processing. This processing is processing for controlling the display so as to rearrange the symbols determined in step S13 after starting scroll of the symbols.

Next, the main CPU 41 determines whether or not a prize has been established (step S15). Here, establishment of the prize in the present embodiment is described.

Figure 6:
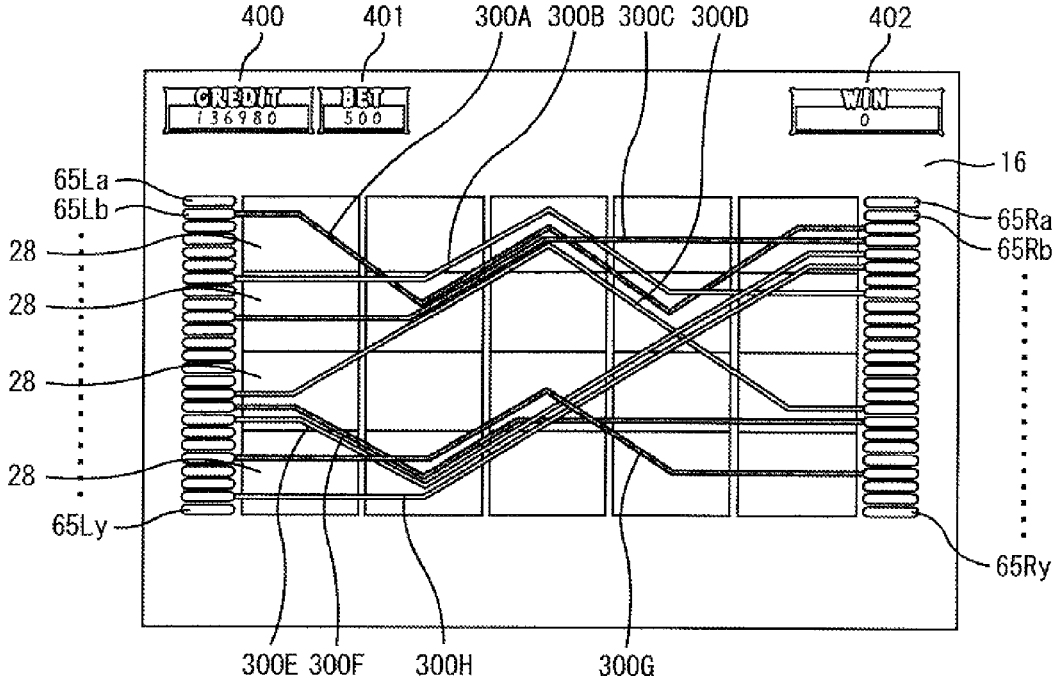
FIG. 6 is a view showing an exemplary image displayed to the lower image display panel provided in the slot machine according to one embodiment of the present invention.

FIG. 6 is a view showing an exemplary image displayed to the lower image display panel provided in the slot machine according to one embodiment of the present invention.

FIG. 7 is a view showing a correspondence relationship among the kind and the number of symbols rearranged on the pay line, and the amount of payout.

As shown in FIG. 6, on the left side of the display blocks 28, 25 pay-line generating portions 65L (65La, 65Lb, 65Lc, 65Ld, 65Le, 65Lf, 65Lg, 65Lh, 65Li, 651Lj, 65Lk, 65Ll, 65Lm, 65Ln, 65Lo, 65Lp, 65Lq, 65Lr, 65Ls, 65Lt, 65Lu, 65Lv, 65Lw, 65Lx, 65Ly) are displayed.

Similarly, on the right side of the display blocks 28, 25 pay-line generating portions 65R (65Ra, 65Rb, 65Rc, 65Rd, 65Re, 65Rf, 65Rg, 65Rh, 65Ri, 65Rj, 65Rk, 65Rl, 65Rm, 65Rn, 65Ro, 65Rp, 65Rq, 65Rr, 65Rs, 65Rt, 65Ru, 65Rv, 65Rw, 65Rx, 65Ry) are displayed.

Each of the pay-line generating portions 65L forms a pair with any one of the pay-line generating portions 65R. The pay line 300 is previously defined as a line from each pay-line generating portion 65L to the pay-line generating portion 65R which is paired with that pay-line generating portion 65L. The pay line 300A connects the pay-line generating portion 65Lb and the pay-line generating portion 65Rc. The pay line 3005 connects the pay-line generating portion 65Lg and the pay-line generating portion 65Rh. The pay line 3000 connects the pay-line generating portion 65Lj and the pay-line generating portion 65Rd. The pay line 300D connects the pay-line generating portion 65Lp and the pay-line generating portion 65Rq. The pay line 300E connects the pay-line generating portion 65Lr and the pay-line generating portion 65Re. The pay line 300F connects the pay-line generating portion 65Lq and the pay-line generating portion 65Rr. The pay line 300G connects the pay-line generating portion 65Lu and the pay-line generating portion 65Rv. The pay line 300H connects the pay-line generating portion 65Lx and the pay-line generating portion 65Rf.

It is to be noted that only eight pay lines 300 are drawn in FIG. 6 for the sake of facilitating the explanation. However, there are still other pay lines 300 in the present embodiment.

In the present embodiment, the number of the pay lines 300 to be set is different in the non-insurance mode and in the insurance mode. The number of the pay lines 300 to be set in the non-insurance mode (pay lines for the uninsured game) is 25. On the other hand, the number of the pay lines 300 to be set in the insurance mode (pay lines for the insured mode) is 30.

Establishment of the prize in the present embodiment refers to a case where at least one combination of two or more symbols of the same type out of "10", "J", "Q", "K", "FLOWER 1", "FLOWER 2", "BIRD" and "FISH" are rearranged on one of the pay lines 300. It is to be noted that "WILD" as the wild symbol is a symbol which can be substituted for another symbol. Namely, in a case where one symbol of "10" and one symbol of "WILD" are displayed on the pay line, it is regarded as a display of two symbols of "10" on the pay line, and determined as winning of the prize.

In the processing of step S15, the main CPU 41 counts the number of symbols of each kind rearranged in step S14 on each pay line 300.

In this processing, when an insurance flag is not set, the main CPU 41 counts the number of symbols of each kind rearranged on each pay line for the uninsured game. Further, when the insurance flag is set, the main CPU 41 counts the number of symbols of each kind rearranged on each pay line for the insured game. The insurance flag is later described.

The main CPU 41 then determines whether or not the number of counted symbols is equal to or more than two.

When determining that the prize has been established, the main CPU 41 executes processing relating to the payout of coins (step S16). In the processing, the main CPU 41 determines the amount of payout based upon the numbers of symbols rearranged on the pay line 300 with reference to the odds data stored in the RAM 43. The odds data is data indicative of the correspondence relationship between the number of symbols rearranged on the pay line 300 and the amount of payout (see FIG. 7). It is to be noted that an amount of payout is doubled for each display of the "WILD" on the pay line 300 where the prize has been established. Namely, when three symbols of "WILD" are displayed on the pay line 300 where the prize has been established, an amount of payout is octuplicated.

In the present embodiment, the case is described where the prize is determined to be established when at least one combination of two or more symbols of the same type out of "10", "J", "Q", "K", "FLOWER 1", "FLOWER 2", "BIRD" and "FISH" are rearranged on the pay line 300. However, in the present invention, the pay line is not necessarily provided, and a prize may be determined to be established when at least one combination of two or more symbols of the same type out of "10", "J", "Q", "K", "FLOWER 1", "FLOWER 2", "BIRD" and "FISH" are rearranged among symbols rearranged in the display blocks 28.

Figure 8A:
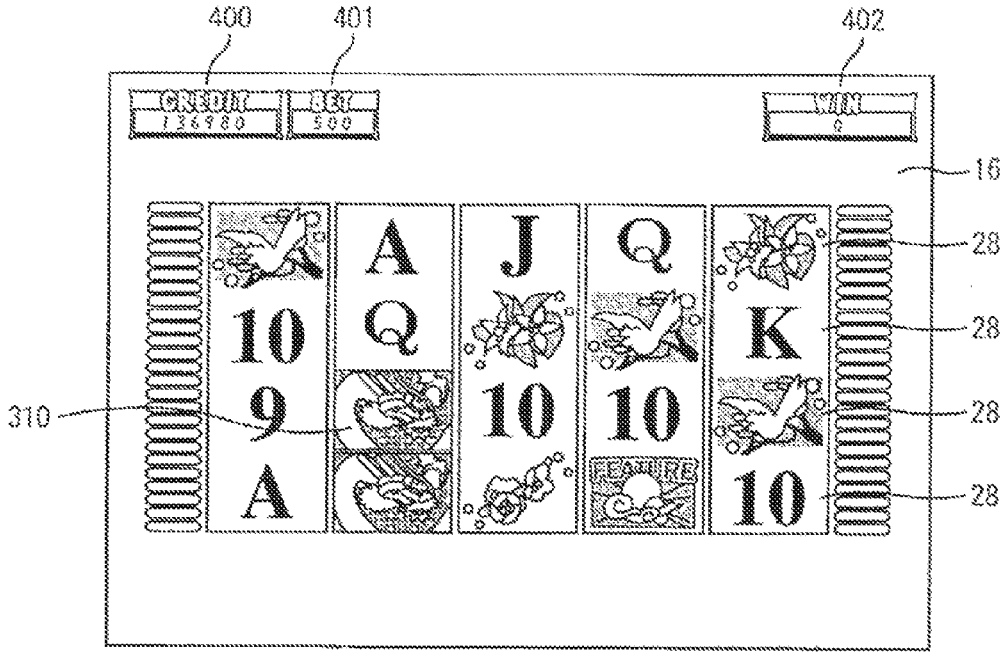
FIG. 8A is a view showing an exemplary image displayed to the lower image display panel provided in the slot machine according to one embodiment of the present invention.

FIG. 8A is a view showing an exemplary image displayed to the lower image display panel provided in the slot machine according to one embodiment of the present invention.

Figure 8B:
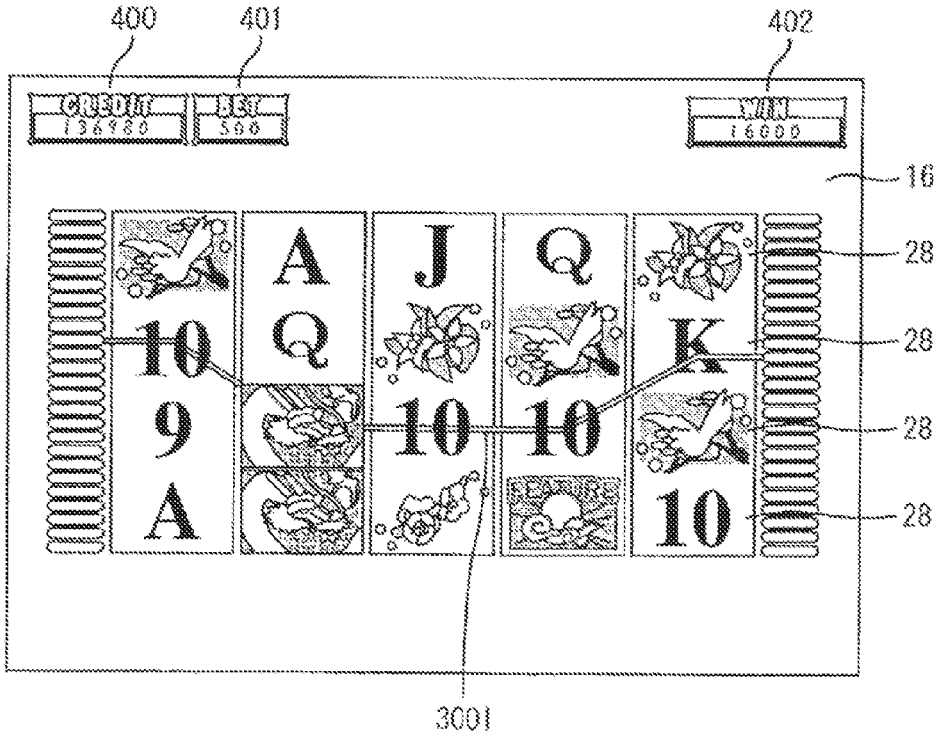
FIG. 8B is a view showing an exemplary image displayed to the lower image display panel provided in the slot machine according to one embodiment of the present invention.

FIG. 8B is a view showing an exemplary image displayed to the lower image display panel provided in the slot machine according to one embodiment of the present invention.

As a result of the scroll-display control processing in step S14, when the symbols shown in FIG. 8A are rearranged, the pay line 300I is displayed as shown in FIG. 8B. On the pay line 300I, three symbols of "10", one symbol of "WILD", and one symbol of "K" are rearranged.

In this case, it is regarded that four symbols of "10" are rearranged and 3000 coins, obtained by multiplying 500 as the number of betted coins by 6, is determined as an amount of payout. Further, it is regarded that two symbols of K are rearranged and 5000 coins, obtained by multiplying 500 as the number of betted coins by 10, is determined as the amount of payout. Moreover, since one symbol of "WILD" is displayed on the pay line 300I where the prize has been established, the amount of payout is doubled. Namely, 16000 coins, obtained by adding 5000 to 3000 to make 8000 and then multiplying 8000 by 2, are determined as the amount of payout.

In the case of accumulating coins, the main CPU 41 conducts processing for adding the number of credits corresponding to the determined amount of payout to the number of credits stored in the RAM 43. On the other hand, in the case of paying out coins, the main CPU 41 transmits a control signal to the hopper 66 in order to pay out coins in an amount corresponding to the determined amount of payout.

When determining in step S15 that the prize is not established, or after executing the processing of step S16, the main CPU 41 determines whether or not the insurance flag is set (step S17). The insurance flag is a flag to be set triggered by the insurance BET button 90 being pressed (cf. step S122 in FIG. 9).

Figure 9:
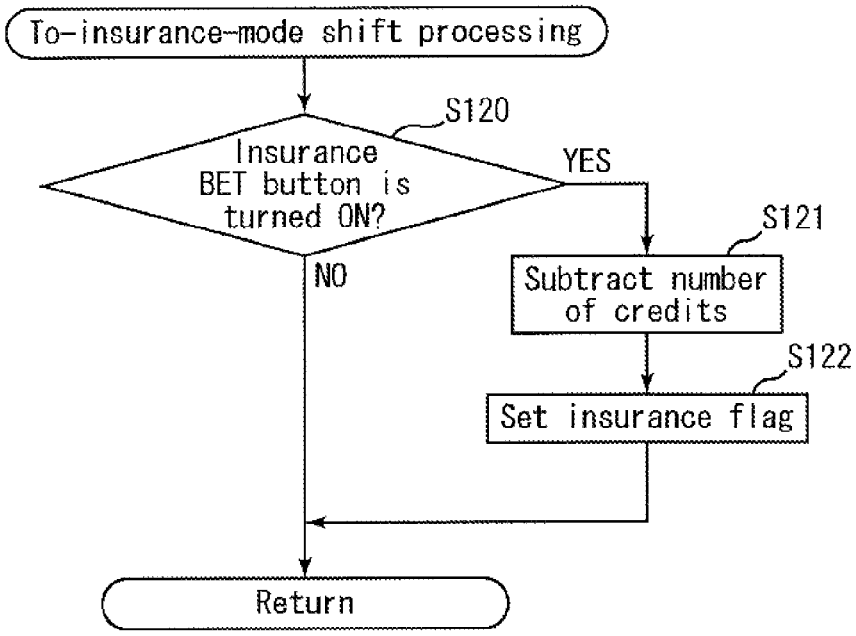
FIG. 9 is a flowchart showing a subroutine of to-insurance-mode shift processing.

Here, the insurance flag is described by using FIG. 9.

FIG. 9 is a flowchart showing a subroutine of to-insurance-mode shift processing.

First, the main CPU 41 determines whether or not the insurance BET button 90 is turned ON at a predetermined timing step S120). In this processing, the main CPU 41 determines whether or not to have received an input signal outputted from the insurance BET switch 90S when the insurance BET button 90 is pressed.

When determining that the insurance BET button 90 is not turned ON, the main CPU 41 completes the present subroutine.

On the other hand, when determining the insurance BET button 90 is turned ON, the main CPU 41 subtracts a predetermined amount (10 dollars in the present embodiment) from the amount of credits stored in the RAM 43 (step S121).

Then, the main CPU 41 sets the insurance flag (step S122) and completes the present subroutine.

It is to be noted that when the predetermined amount is larger than the amount of credits stored in the RAM 43, the main CPU 41 completes the present subroutine without conducting the processing of step S121 and step S122.

As above, the insurance flag has been described by using FIG. 9.

The description is returned to FIG. 4.

When determining that the insurance flag is set, the main CPU 41 updates the cumulative number of BETs (step S18). In this processing, the main CPU 41 adds the number of coins betted in step S10 to the cumulative number of BETs indicated by the cumulative-number-of-BETs data stored in the cumulative-number-of-BETs storage area in the RAM 43.

Next, the main CPU 41 calculates the average number of BETs (step S19). In this processing, the main CPU 41 calculates the average number of BETs based upon the cumulative-number-of-data stored BETs in the cumulative-number-of-BETs storage area in the RAM 43 and the data on the number of the with-insurance games stored in the storage area of the number of the with-insurance games in the RAM 43. Then, the main CPU 41 stores the average-number-of-BETs data indicative of the calculated average number of BETs in the average-number-of-BETs storage area in the RAM 43.

When determining that the insurance flag is not set in step S17, or after executing the processing of step S19, the main CPU 41 determines whether or not three or more feature symbols 100 (cf. FIG. 1C) are rearranged (step S20). In this processing, the main CPU 41 determines whether or not three or more feature symbols 100 have been rearranged in the display blocks 28, without considering the pay line 300.

When determining in step S20 that three, or more feature symbols 100 have been rearranged, the main CPU 41 executes the first-free-game execution processing (step S21). In the first-free-game execution processing, a free game with the number of wild symbols increased is executed. The first-free-game execution processing is later described in detail using FIG. 11.

When determining in step S20 that three or more feature symbols 100 are not rearranged or after executing the processing of step S21, the main CPU 41 executes insurance processing (step S22). The insurance processing is later described in detail using FIG. 21.

After executing the processing of step S22, the main CPU 41 completes the present subroutine.

Figure 10:
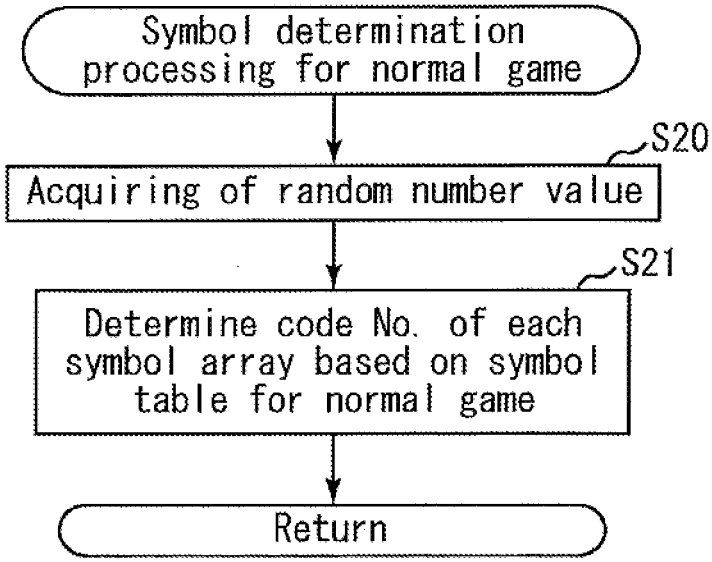
FIG. 10 is a flowchart showing a subroutine of symbol determination processing for a normal game.

FIG. 10 is a flowchart showing a subroutine of symbol determination processing for a normal game.

This processing is processing performed by the main CPU 41 executing the symbol determination program stored in the RAM 43.

First, the main CPU 41 acquires random number values from the random number generator 64 (step S20). In this processing, the main CPU 41 acquires five random number values corresponding to the respective symbol arrays of the display blocks 28.

Next, based upon the acquired five random number values and the symbol table for the normal game, the main CPU 41 determines a code number of each symbol array of the display blocks 28 at stopping the symbols (step S21). For example, in a case where the random number value for the first array is "23035", "07" is determined as the code number of the first array. It should be noted that a code number of a symbol array corresponds to the code numbers of symbols to be rearranged to the display blocks 28 in the first row of the display blocks 28 that are put in four rows.

After executing the processing of step S21, the main CPU 41 completes the present subroutine.

In the present embodiment, the case has been described where the random number generator 64 is provided and a random number is extracted from the random number generator (a case of using a so-called hardware random number). However, in the present invention, a random number may be generated on the program (a case of using a so-called software random number).

Next, the first-free-game execution processing is described with reference to FIG. 11.

Figure 11:
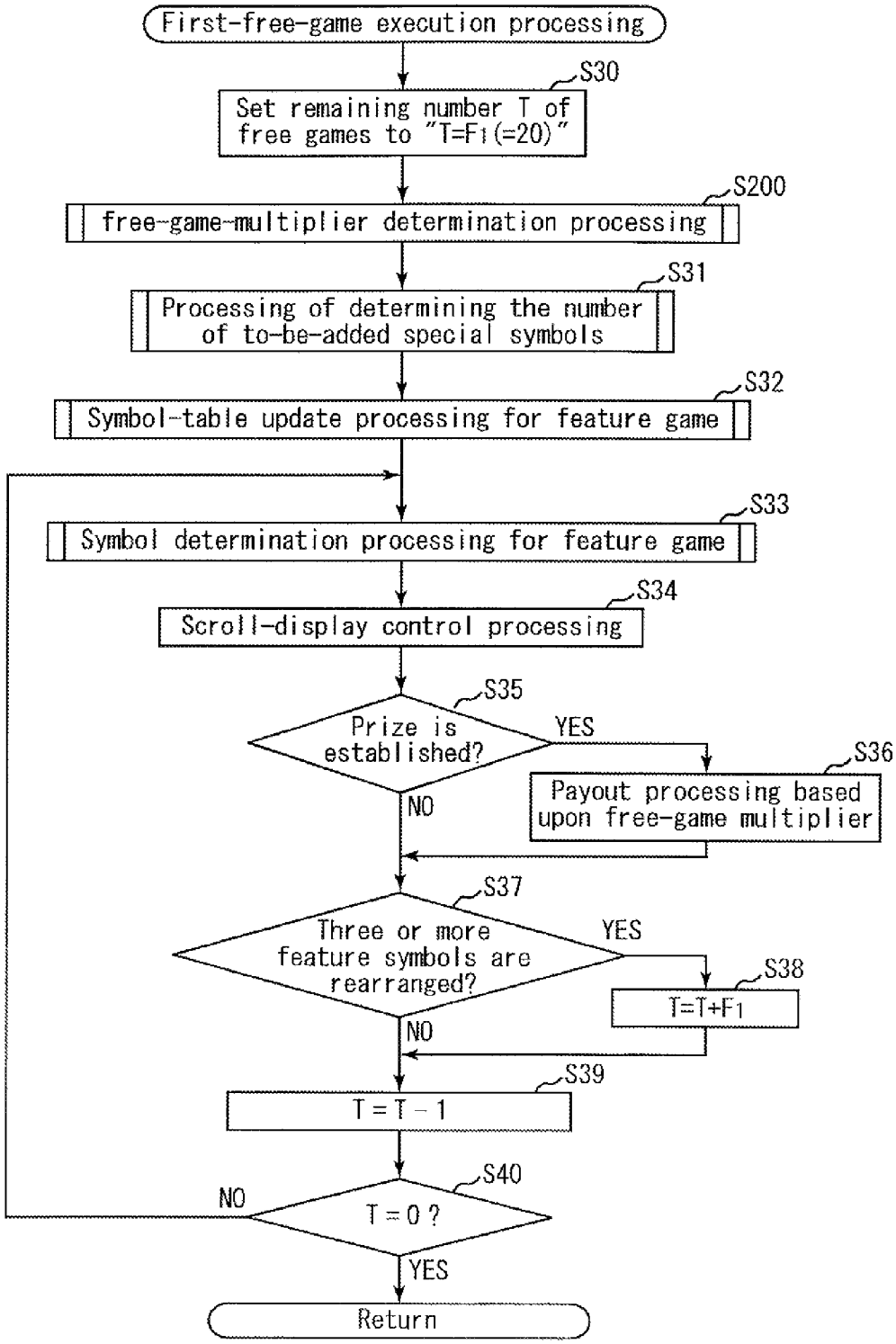
FIG. 11 is a flowchart showing a subroutine of first-free-game execution processing.

FIG. 11 is a flowchart showing a subroutine of first-free-game execution processing.

It should be noted that, in the first free game, the player can play the game without betting coins.

First, the main CPU 41 sets the remaining number T of the free game to "$T=F_1$ (=20)" in the number-of-free-games storage area in the RAM 43 (step S30).

Next, the main CPU 41 conducts free-game-multiplier determination processing (step S200). The free-game-multiplier determination processing is later described by using FIG. 12.

After executing the processing of step S30 and step S200, the main CPU 41 displays the free-game-generated image 200 (cf. FIG. 1D) to the lower image display panel 16.

Next, the main CPU 41 executes processing of determining the number of the to-be-added special symbols (step S31). In the processing of determining the to-be-added special symbols, the main CPU 41 determines the number of the to-be-added wild symbols based upon the selection image 302 (cf. FIG. 13A) selected by the player. The processing of determining the to-be-added special symbols is later described in detail using the drawing.

Next, the main CPU 41 executes the symbol-table update processing for the feature game (step S32). In the symbol-table update processing for the feature game, the main CPU 41 updates the symbol table for the feature game, based upon the number of the to-be-added wild symbols, which has been determined by the processing of determining the to-be-added special symbols. The symbol-table update processing for the feature game is later described in detail using the drawing.

Next, the main CPU 41 executes the symbol determination processing for the feature game (step S33).

FIGS. 19A and 19B are examples of a symbol table for the feature game, each showing the correspondence relationship among each symbol in each symbol array of the display block, the code number and the random number value.

The symbol table for the feature game shown in each of FIGS. 19A and 19B is stored into the RAM 43 by later-described symbol-table update processing for the feature game.

In the symbol determination processing for the feature game, the main CPU 41 executes the symbol determination program stored in the RAM 43, to determine code numbers at stopping the symbols. Specifically, the main CPU 41 acquires random number values, and determines the code numbers of respective symbol arrays at the time of stopping the symbols based upon the acquired random number values and the symbol table for the feature game. The symbol determination processing for the feature game is later described in detail using the drawing.

Next, in step S34, the main CPU 41 performs the scroll-display control processing. This processing is processing for controlling the display so as to rearrange the symbols determined in step S33 after starting the scrolling of the symbols.

Next, the main CPU 41 determines whether or not a prize has been established (step S35).

As described above, establishment of the prize in the present embodiment refers to a case where at least one combination of two or more symbols of the same type out of "10", "J", "Q", "K", "FLOWER 1", "FLOWER 2", "BIRD" and "FISH" are rearranged on the pay line 300. It is to be noted that "WILD" as the wild symbol is a symbol which can be substituted for another symbol. In the feature game, since the number of the wild symbols has become larger than that in the normal game, the prize is more likely to be established compared to in the normal game.

In the processing of step S35, the main CPU 41 counts the number of symbols of each kind rearranged in step S34 on each pay line 300. The main CPU 41 then determines whether or not the counted number is equal to or more than two.

When determining that the prize has been established, the main CPU 41 conducts processing relating to the payout of coins based upon the free-game-multiplier data stored in the free-game-multiplier storage area in the RAM 43 (step S36).

For example, in a case where symbols shown in FIG. 8A are rearranged when the free-game multiplier is 240, the main CPU 41 determines the amount of payout as follows.

As shown in FIG. 8B, three symbols of "10", one symbol of "WILD", and one symbol of "K" are rearranged on the pay line 300I.

In this case, it is considered that four symbols of "10" are rearranged and 1440 coins, obtained by multiplying 240 as the free-game multiplier by 6, is determined as the amount of payout. Further, it is considered that two symbols of "K" are rearranged and 2400 coins, obtained by multiplying 240 as the free-game multiplier by 10, is determined as the amount of payout. Furthermore, since one symbol of "WILD" is displayed on the pay line 300I where the prize has been established, the amount of payout is doubled. Namely, 7680 coins, obtained by adding 2400 to 1440 to make 3840 and then multiplying 3840 by 2, are determined as the amount of payout. Then, the main CPU 41 conducts processing relating to the payout of coins in number corresponding to the determined amount of payout.

When determining that the prize has not been established in the processing of step S35, or after executing the processing of step S36, the main CPU 41 determines whether or not three or more feature symbols 100 (cf. FIG. 1C) are rearranged (step S37). In the processing, the main CPU 41 determines whether or not three or more feature symbols 100 are rearranged in the display blocks 28, without taking the pay line 300 into consideration.

When determining in step S37 that three or more feature symbols 100 are rearranged, the main CPU 41 sets the remaining number T of the free game to "$T=T+F_1$" ($F_1=20$) in the number-of-free-games storage area in the RAM 43 (step S38).

When determining in step S37 that three or more feature symbols 100 are not rearranged, or after executing the processing of step S38, the main CPU 41 sets the remaining number T of the free game to "$T=T-1$" in the number-of-free-games storage area in the RAM 43 (step S39).

Next, the main CPU 41 determines whether or not T is "T=0" based upon the remaining-number data stored in the number-of-free-games storage area in the RAM 43 (step S40).

When determining that T is not "T=0", the main CPU 41 returns the processing to step S33. On the other hand, when determining that T is "T=0", the main CPU 41 completes the present subroutine.

Subsequently, free-game-multiplier determination processing conducted in step S200 in FIG. 11 is described by using FIG. 12.

Figure 12:
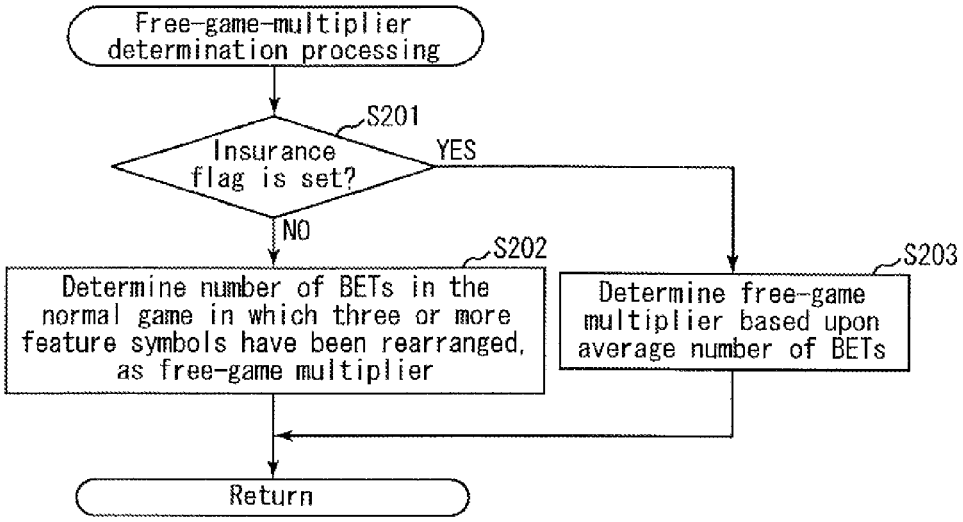
FIG. 12 is a flowchart showing a subroutine of free-game-multiplier determination processing.

FIG. 12 is a flowchart showing a subroutine of free-game-multiplier determination processing.

First, the main CPU 41 determines whether or not the insurance flag is set (step S201).

When determining that the insurance flag is not set, the main CPU 41 determines the number of coins betted in step S10 in the normal game in which three or more feature symbols 100 have been rearranged, as the free-game multiplier (step S202). Then, the main CPU 41 stores the free-game-multiplier data indicative of the determined free-game multiplier in the free-game-multiplier storage area in the RAM 43.

When determining that the insurance flag is set, the main CPU 41 determines the free-game multiplier based upon the average-number-of-BETs data stored in the average-number-of-BETs storage area in the RAM 43 (step S203). In this processing, the main CPU 41 determines N which satisfies $N \leq$(average number of BETs)$<N+1$, as the free-game multiplier. Then, the main CPU 41 stores the free-game-multiplier data indicative of the determined free-game multiplier in the free-game-multiplier storage area in the RAM 43.

After executing the processing of step S202 or step S203, the main CPU 41 completes the present subroutine.

Subsequently, there is described processing of determining the number of to-be-added special symbols conducted in step S31 in FIG. 11 by using FIGS. 13 to 15.

Figure 13A:
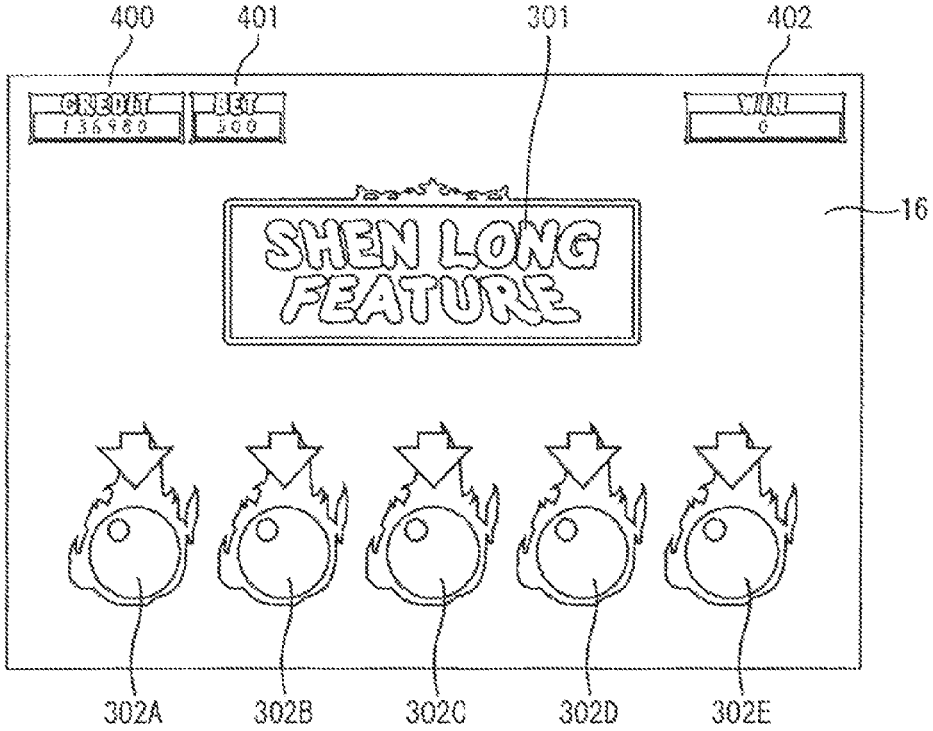
FIG. 13A is a view showing an exemplary image displayed to the lower image display panel provided in the slot machine according to one embodiment of the present invention.
Figure 13B:
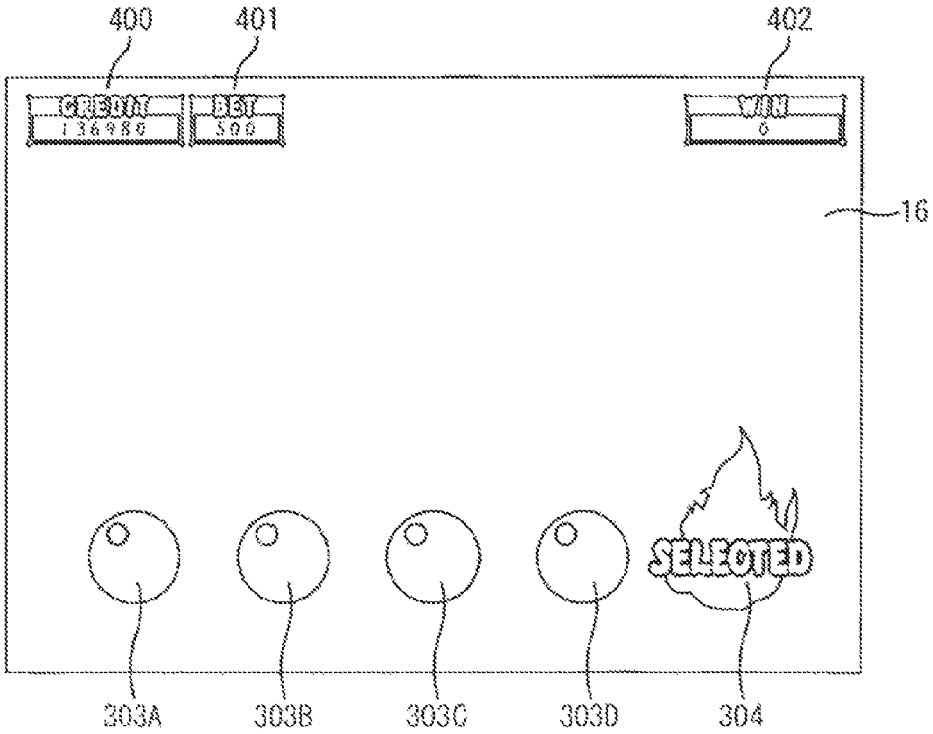
FIG. 13B is a view showing an exemplary image displayed to the lower image display panel provided in the slot machine according to one embodiment of the present invention.
Figure 13C:
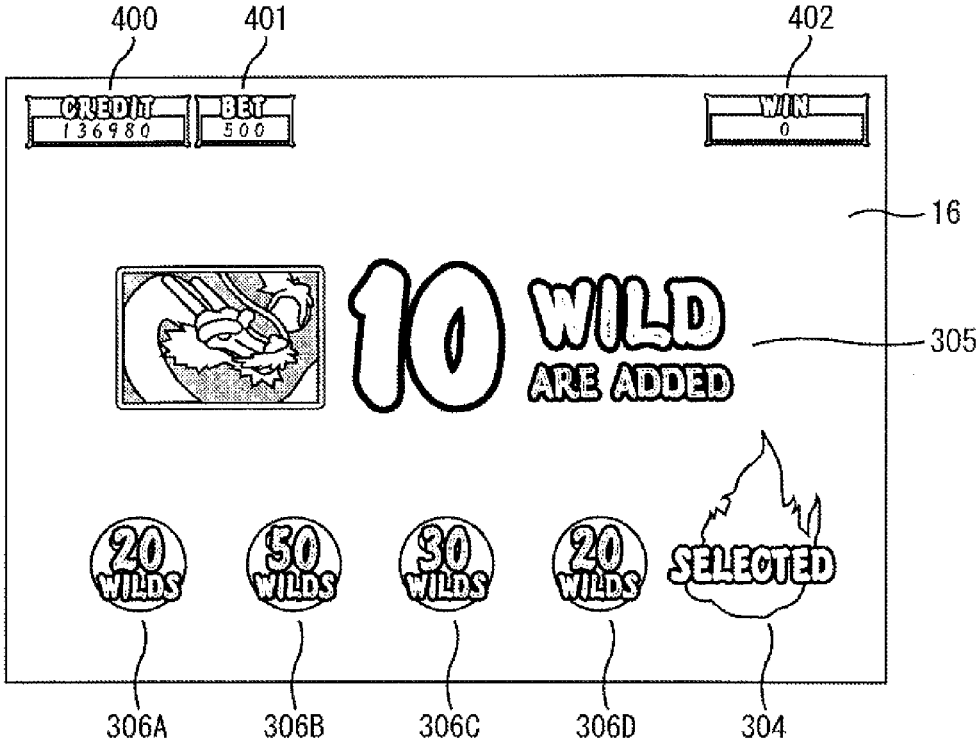
FIG. 13C is a view showing an exemplary image displayed to the lower image display panel provided in the slot machine according to one embodiment of the present invention.

FIGS. 13A to 13C are views each showing an exemplary image displayed to the lower image display panel provided in the slot machine according to one embodiment of the present invention.

When three or more feature symbols 100 are rearranged, the image shown in FIG. 13A is displayed to the lower image display panel 16.

As shown in FIG. 13A, a feature-game start image 301 showing the start of the feature game is displayed to the center part of the lower image display panel 16.

To the lower part of the lower image display panel 16, five selection images 302 (the selection image 302A, the selection image 302B, the selection image 302C, the selection image 302D, the selection image 302E) are displayed. The player can select the selection image 302 by touching the touch panel 69 (cf. FIG. 3) provided on the lower image display panel 16 with his or her finger or the like. Based upon the selection image 302 selected by the player, the number of the to-be-added wild symbols is determined.

For example, when the selection image 302E is selected by the player, as shown in FIG. 13B, a selected image 304 is displayed at the position where a selection image 302E has been displayed on the lower image display panel 16. Further, at the positions where the unselected images 302 have been displayed, non-selected images 303 (the non-selected image 303A, the non-selected image 3038, the non-selected image 303C, the non-selected image 303D) are displayed.

After the image shown in FIG. 13B is displayed, as shown in FIG. 13C, the to-be-added number determination image 305 showing the number of the to-be-added wild symbols is displayed to the center part of the lower image display panel 16. In FIG. 130, the to-be-added number determination image 305 shows that the wild symbols will be increased by ten. Further, the to-be-added number images 306 (the to-be-added number image 306A, the to-be-added number image 306B, the to-be-added number image 306C, the to-be-added number image 306D) are displayed to the lower part of the lower image display panel 16, each showing the number of the wild symbols which would have been increased if another selection image 302 had been selected. The to-be-added number image 306A, the to-be-added number image 306B, the to-be-added number image 306C and the to-be-added number image 306D respectively show that the wild symbols would have been increased by 20, 50, 30 and 20, if the selection image 302 displayed in the corresponding place had been selected.

Figure 14:
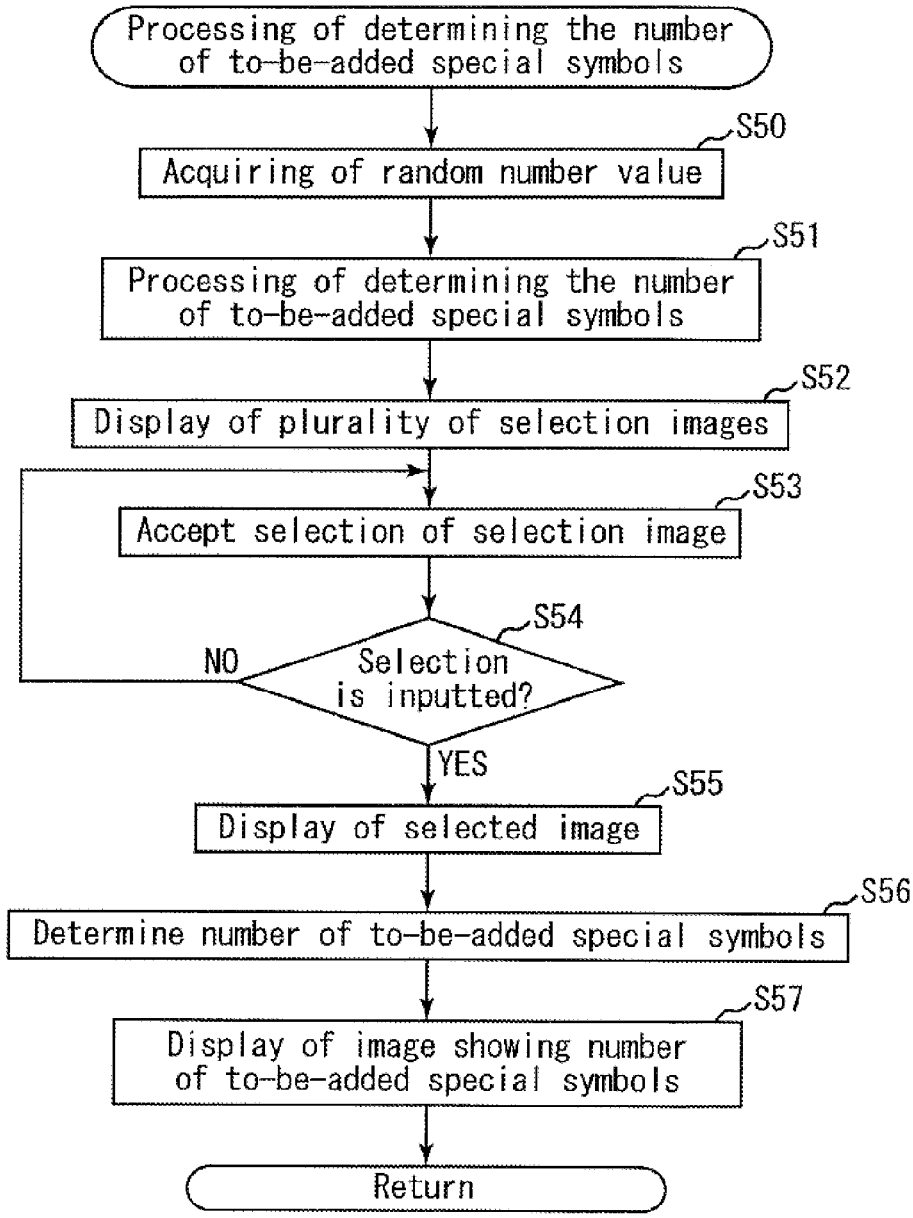
FIG. 14 is a flowchart showing a subroutine of processing of determining the number of to-be-added special symbols.

FIG. 14 is a flowchart showing a subroutine of processing of determining the number of the to-be-added special symbols.

First, the main CPU 41 acquires random number values from the random number generator 64 (step S50). In this processing, the main CPU 41 acquires five random number values corresponding to the respective selection images 302 (the selection image 302A, the selection image 302D, the selection image 302C, the selection image 302D and the selection image 302E (cf. FIG. 13A)).

Next, the main CPU 41 determines the number of the to-be-added special symbols corresponding to each selection image 302 (step S51). In this processing, the main CPU 41 determines the number of the to-be-added special symbols corresponding to each selection image 302, based upon the random number value obtained in step S50 and a table for determining the number of the to-be-added special symbols, which is shown in FIG. 15.

FIG. 15 is a view showing a table for determining the number of the to-be-added special symbols.

The table for determining the number of the to-be-added special symbols shows the correspondence relationship between the number of the to-be-added special symbols and the random number value.

For example, when random number value corresponding to the selection image 302A, the selection image 302B, the selection image 3020, the selection image 302D and the selection image 3023 are respectively 17235, 63123, 32387, 22332, 3423, numbers of 20, 50, 30, 20 and 10 respectively correspond to the selection image 302A, the selection image 302B, the selection image 302C, the selection image 302D and the selection image 302E, as the number of the to-be-added special symbols.

Next, the main CPU 41 displays the selection image 302A, the selection image 302B, the selection image 3020, the selection image 302D and the selection image 3023 to the lower part of the lower image display panel 16 (step S52). The main CPU 41 then receives the selection of the selection image 302 made by the player (step S53).

Next, the main CPU 41 determines whether or not an input for selecting the selection image 302 has been made (step S54). In this processing, the main CPU 41 determines whether or not to have received an input signal for selecting the selection image 302 from the touch panel 69. By the player touching a place in the vicinity of where the selection image 302E is displayed, on the lower image display panel 16 by his or her finger or the like, the input signal for selecting the selection image 302E is transmitted from the touch panel 69 to the main CPU 41. When determining not to have received the input for selecting the selection image 302, the main CPU 41 returns the processing to step S53.

On the other hand, when determining in step S54 that the input for selecting the selection image 302 has been made, the main CPU 41 displays the selected image 304 (cf. FIG. 13B) (step S55).

Next, the main CPU 41 determines the number of the to-be-added special symbols corresponding to the selection image 302 selected by the player, as the number of the special symbols to be added (step S56).

For example, in a case where 20, 50, 30, 20 and 10 as the number of the to-be-added special symbols respectively correspond to the selection image 302A, the selection image 302B, the selection image 302C, the selection image 302D and the selection image 302E, and when the selection image 302E is selected by the player, 10 is determined as the number of the to-be-added special symbols. Next, the main CPU 41 displays the to-be-added number determination image 305 (cf. FIG. 13C) showing the number of the to-be-added special symbols to the center part of the lower image display panel 16 (step S57).

After executing the processing of step S57, the main CPU 41 completes the present subroutine.

In the present embodiment, the case has been described where the number of the to-be-added special symbols corresponding to each selection image 302 is determined based upon the acquired random number value and the table for determining the number of the to-be-added special symbols, which is shown in FIG. 15. However, in the present invention, the number of the to-be-added special symbols corresponding to each selection image 302 may be previously determined.

Figure 16:
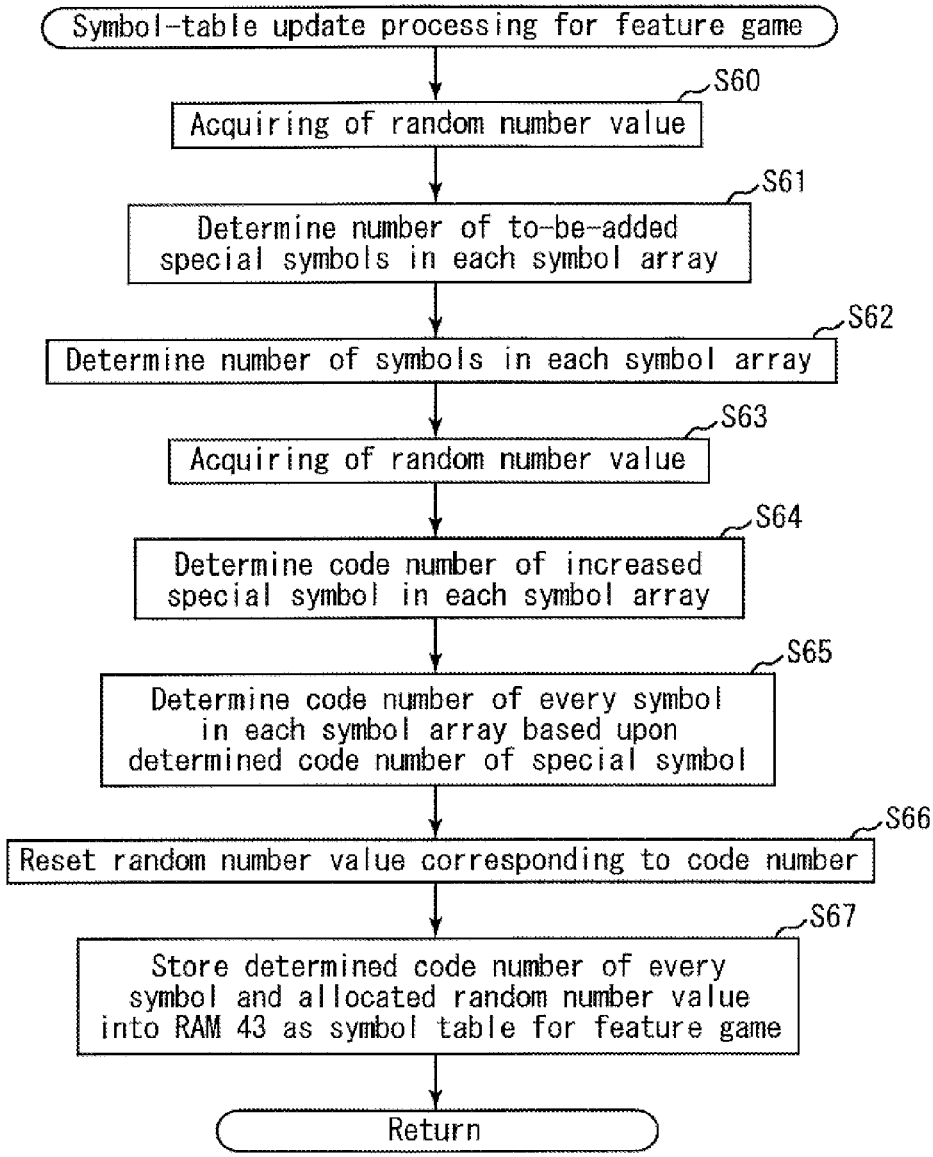
FIG. 16 is a flowchart showing a subroutine of symbol-table update processing for a feature game.

FIG. 16 is a flowchart showing a subroutine of symbol-table update processing for a feature game.

First, the main CPU 41 acquires random number values from the random number generator 64 (step S60). In this processing, the main CPU 41 acquires random number values in the same number as the number of the to-be-added special symbols, which is determined in step S56.

Next, the main CPU 41 determines the number of the to-be-added special symbols in each symbol array (step S61). In this processing, the main CPU 41 determines the number of the to-be-added special symbols in each symbol array, based upon the random number value acquired in step S60 and the symbol-array determination table shown in FIG. 17.

FIG. 17 is a view showing the symbol-array determination table.

The symbol-array determination table shows the correspondence relationship between the symbol array No. and the random number value. It is to be noted that a symbol array No. 1 shows the first column of the display blocks 28, a symbol array No. 2 shows the second column of the display blocks 28, a symbol array No. 3 shows the third column of the display blocks 28, a symbol array No. 4 shows the fourth column of the display blocks 28, and a symbol array No. 5 shows the fifth column of the display blocks 28.

For example, when the random number values acquired in step S60 are 2313, 3123, 12382, 17325, 28768, 30223, 45235, 48766, 58776 and 62356, the number of the to-be-added special symbols in the symbol array No. 1 (the first column) is three, the number of the to-be-added special symbols in the symbol array No. 2 (the second column) is one, the number of the to-be-added special symbols in the symbol array No. 3 (the third column) is two, the number of the to-be-added special symbols in the symbol array No. 4 (the fourth column) is two, and the number of the to-be-added special symbols in the symbol array No. 5 (the fifth column) is two.

In the present embodiment, the case has been described where the number of special symbols to be added to each symbol array is determined based upon the acquired random number value and the symbol-array determination table shown in FIG. 17. However, in the present invention, the number of special symbols to be added to each symbol array may be previously determined according to each of the numbers of to-be-added special symbols, which is to be determined in the processing of determining the number of the to-be-added special symbols.

Next, the main CPU 41 determines the number of the symbols in each symbol array (step S62). In this processing, the main CPU 41 determines a total number of the symbols in each symbol array based upon the number of the to-be-added special symbols, which has been determined in step S61. Specifically, the total number of the symbols in each symbol array is a numeric value obtained by adding 20 as the number of the symbols in each symbol array shown by the symbol table for a normal game, to the number of the to-be-added special symbols in each symbol array, which has been determined in step S61.

Next, the main CPU 41 acquires random number values from the random number generator 64 (step S63). In this processing, the main CPU 41 acquires random number values in the same number as the number of the to-be-added special symbols in each symbol array, which has been determined in step S61. Namely, when the number of the to-be-added special symbols in the symbol array No. 1 (the first column) is three, the main CPU 41 acquires three random number values for the symbol array No. 1 (the first column).

Next, the main CPU 41 determines a code number of the special symbol to be added in each symbol array, based upon the random number value acquired in step S63 (step S64). In this processing, the main CPU 41 determines a code number of the special symbol to be added in each symbol array based upon the random number value acquired in step S63 and a code-number determination table shown in FIG. 18.

FIG. 18 is a view showing the code-number determination table.

The code-number determination table shows the correspondence relationship between the code number and the random number value.

For example, in a case where the random number values of the symbol array No. 1 (the first column) are 40567, 63535 and 65323, the code numbers are determined to be "13", "End" and "End".

In the present embodiment, the case has been described where a code number of the special symbol to be added in each symbol array is determined based upon the acquired random number value and the code-number determination table shown in FIG. 18. However, in the present invention, a code number of the special symbol to be added may be previously determined for each symbol array.

Next, the main CPU 41 determines a code number of every symbol in each symbol array based upon the code number of the special symbol determined in step S64 (step S65). In this processing, based upon the code number of the special symbol determined in step S64, the special symbol is added to each symbol array shown by the symbol table for a normal game in FIG. 5. For example, in a case where "13", "End" and "End" are determined in step S64 as the code numbers of the special symbols to be added in the symbol array No. 1 (the first column), the wild symbol of "WILD" as the special symbol is added to code No. 13 in the symbol array No. 1 (the first column) shown in the symbol table for a normal game, and "FLOWER 2" originally corresponding to code No. 13 is displaced to code No. 14. In the same manner, each symbol is displaced from its original code number. Further, since there are two special symbols determined to have the code number of "End", the symbols of "WILD" are added to code No. 21 and code No. 22 as the ends of the symbol array No. 1 (the first column). In the same manner, a code number of every symbol in each of the other symbol arrays is determined.

The main CPU 41 resets the random number values corresponding to the code numbers of each symbol array (step S66). In this processing, the main CPU 41 resets the correspondence relationship between the respective random number values from 0 to 65535 and the code numbers, based upon the total number of symbols in each symbol array which has been determined in step S62.

The main CPU 41 stores the correspondence relationship between the code number of every symbol in each symbol array, which has been determined in step S65, and the random number value corresponding to the code number of each symbol array, which has been determined in step S66, into the RAM 43 as the symbol table for a feature game (step S67). The symbol table for a feature game stored in the RAM 43 is referred to in executing the symbol determination processing for a feature game.

FIGS. 19A and 19B each are an example of the symbol table for a feature game, which shows the correspondence relationship among each symbol in each symbol array of the display blocks, the code number and the random number value.

In FIG. 19A, the wild symbols are added to code Nos. 13, 21 and 22 of the symbol array No. 1 (the first column). Further, the wild symbol is added to code No. 12 of the symbol array No. 2 (the second column). Furthermore, the wild symbols are added to code Nos. 6 and 13 of the symbol array No. 3 (the third column). Further, in FIG. 19B, the wild symbols are added to code Nos. 11 and 12 of the symbol array No. 4 (the fourth column) Moreover, the wild symbols are added to code Nos. 19 and 20 of the symbol array No. 5 (the fifth column).

After executing the processing of step S67, the main CPU 41 completes the present subroutine.

Figure 20:
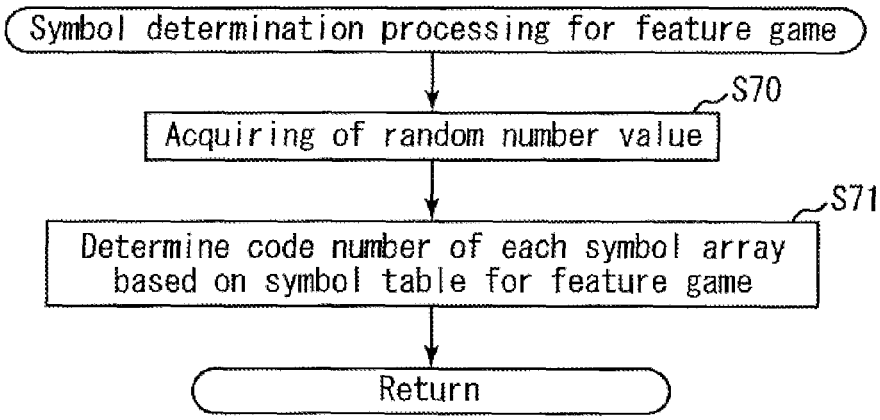
FIG. 20 is a flowchart showing a subroutine of symbol determination processing for a feature game.

FIG. 20 is a flowchart showing a subroutine of the symbol determination processing for a feature game.

This processing is processing performed by the main CPU 41 executing the symbol determination program stored in the RAM 43.

First, the main CPU 41 acquires random number values from the random number generator 64 (step S70). In this processing, the main CPU 41 acquires five random number values corresponding to the respective symbol arrays of the display blocks 28.

Next, the main CPU 41 determines a code number at stopping the symbols in each symbol array of the display blocks 28, based upon the acquired five random number values and the symbol table for a feature game (step S71). For example, in a case where the random number value of the first array is "23035", the number of "08" is determined as the code number of the first array. It should be noted that a code number of a symbol array corresponds to a code number of a symbol rearranged in the first array of the display blocks 28 out of the four columns arrayed in the display blocks 28.

After executing the processing of step S71, the main CPU 41 completes the present subroutine.

Subsequently, the insurance processing conducted in step S22 in FIG. 4 is described, by using FIGS. 21 to 23.

Figure 21:
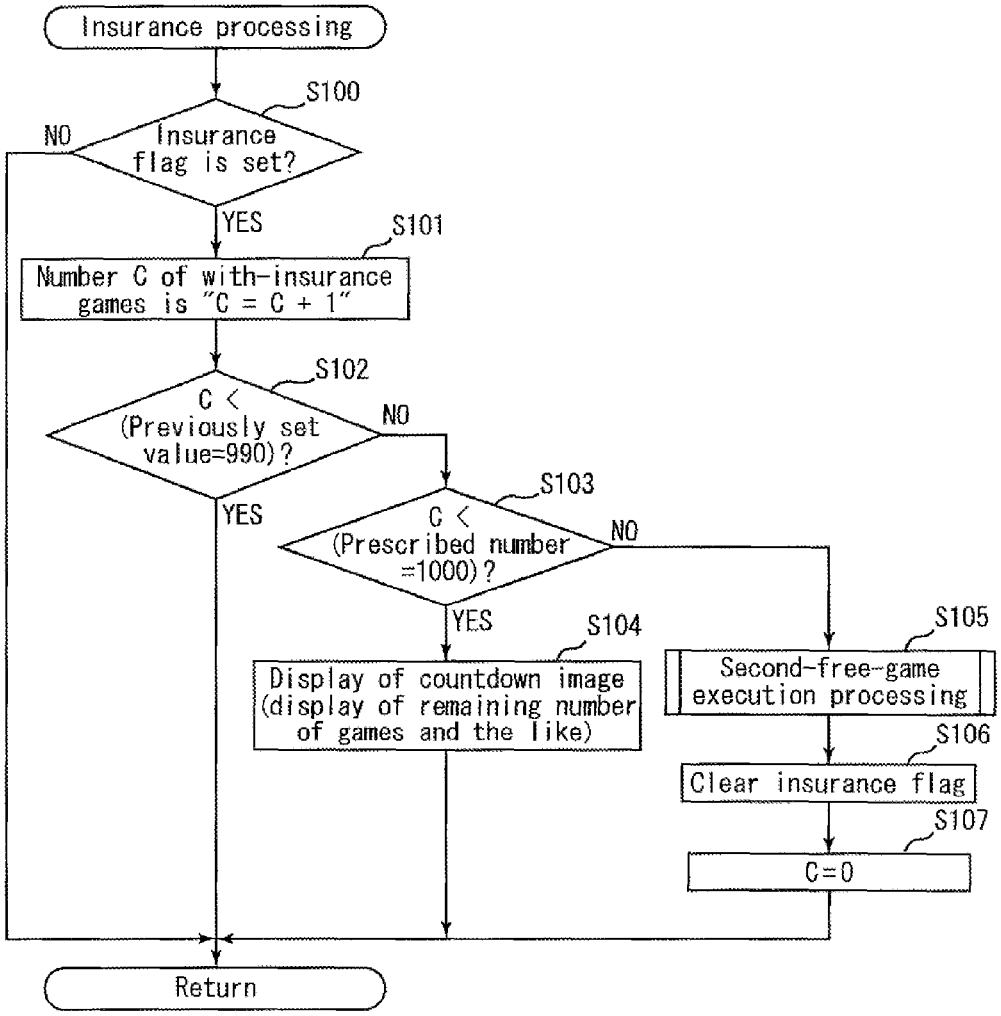
FIG. 21 is a flowchart showing a subroutine of insurance processing.

FIG. 21 is a flowchart showing a subroutine of the insurance processing.

First, the main CPU 41 determines whether or not the insurance flag is set (step S100).

When determining in step S100 that the insurance flag is not set, the main CPU 41 completes the present subroutine.

On the other hand, when determining in step S100 that the insurance flag is set, the main CPU 41 sets the number C of with-insurance games to "C=C+1" in the storage area of the number of the with-insurance games in the RAM 43 (step S101).

Next, the main CPU 41 determines whether or not the number C of the with-insurance games is smaller than a previously set value (990) based upon the data on the number of the with-insurance games stored in the storage area of the number of the with-insurance games in the RAM 43 (step S203).

When determining that the number C of the with-insurance games is smaller than the previously set value (990), the main CPU 41 completes the present subroutine.

On the other hand, when determining that the number C of the with-insurance games is equal to or more than the previously set value (990), the main CPU 41 determines whether or not the number C of the with-insurance games is smaller than the prescribed number (1000) (step S103).

When determining that the number C of the with-insurance games is smaller than the prescribed number (1000), the main CPU 41 displays the countdown image 500 to the lower image display panel 16 (step S104).

As described by using FIG. 1A, the countdown image 500 is an image showing the number C of the with-insurance games until the number of the counted normal games reaches the prescribed number (1000).

Figure 22A:
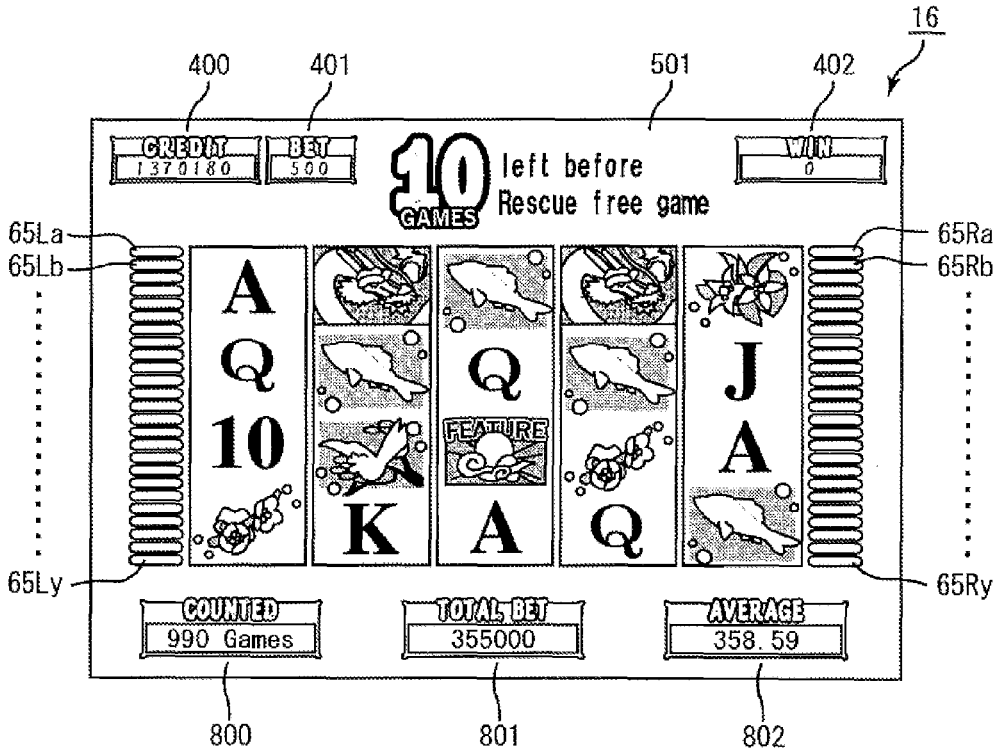
FIG. 22A is a view showing an exemplary image displayed to the lower image display panel provided in the slot machine according to one embodiment of the present invention.
Figure 22B:
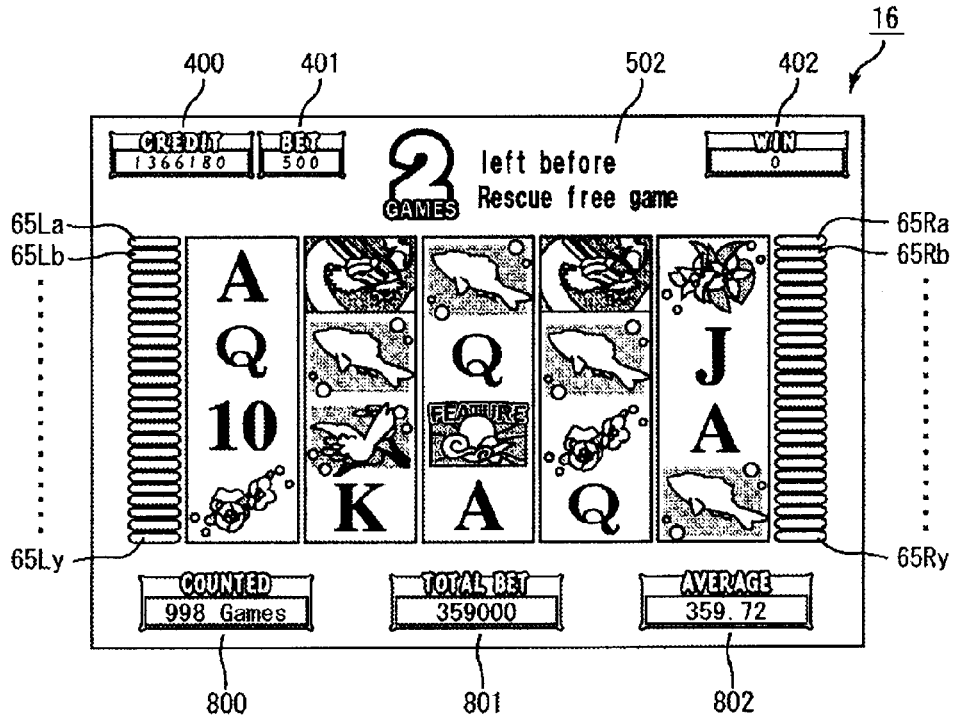
FIG. 22B is a view showing an exemplary image displayed to the lower image display panel provided in the slot machine according to one embodiment of the present invention.
Figure 22C:
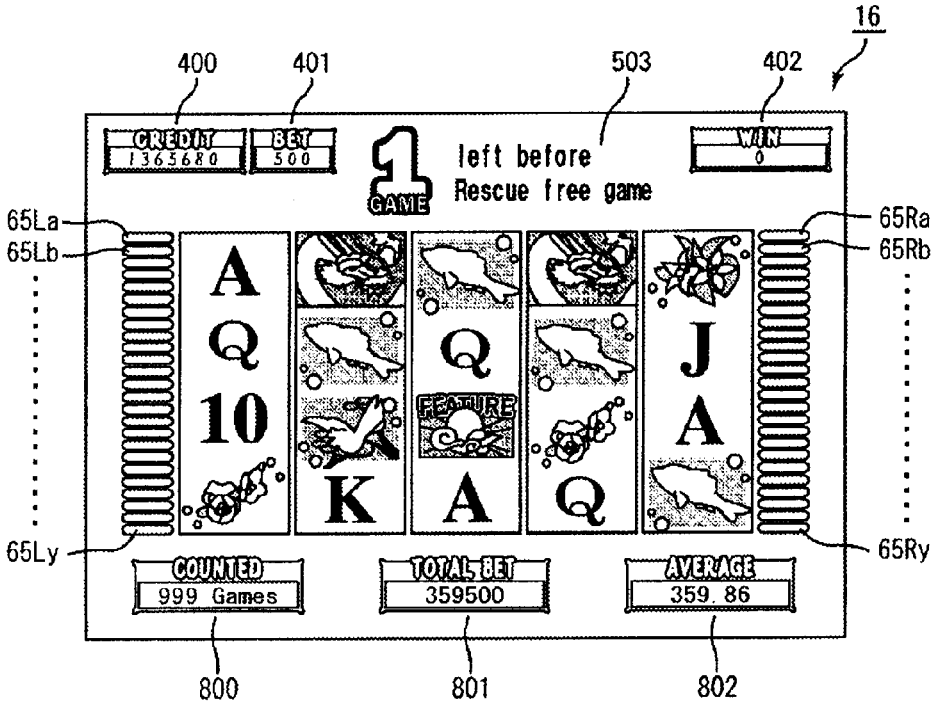
FIG. 22C is a view showing an exemplary image displayed to the lower image display panel provided in the slot machine according to one embodiment of the present invention.

By using FIGS. 22A to 22C, a state is shown, where the number C of the with-insurance games is decreased until the number of the counted normal games reaches the prescribed number (1000).

FIGS. 22A to 22C are views each showing an exemplary image displayed to the lower image display panel.

In FIG. 22A, a state is shown, where 10 games are left until the number C of the with-insurance games reaches the prescribed number (1000). In FIG. 22B, a state is shown, where 2 games are left until the number C of the with-insurance games reaches the prescribed number (1000). In FIG. 22C, a state is shown, where 1 game is left until the number C of the with-insurance games reaches the prescribed number (1000).

After executing the processing of step S104, the main CPU 41 completes the present subroutine.

When determining in step S103 that the number C of the with-insurance games is the prescribed number (1000), the main CPU 41 executes second-free-game execution processing (step S105).

Figure 23:
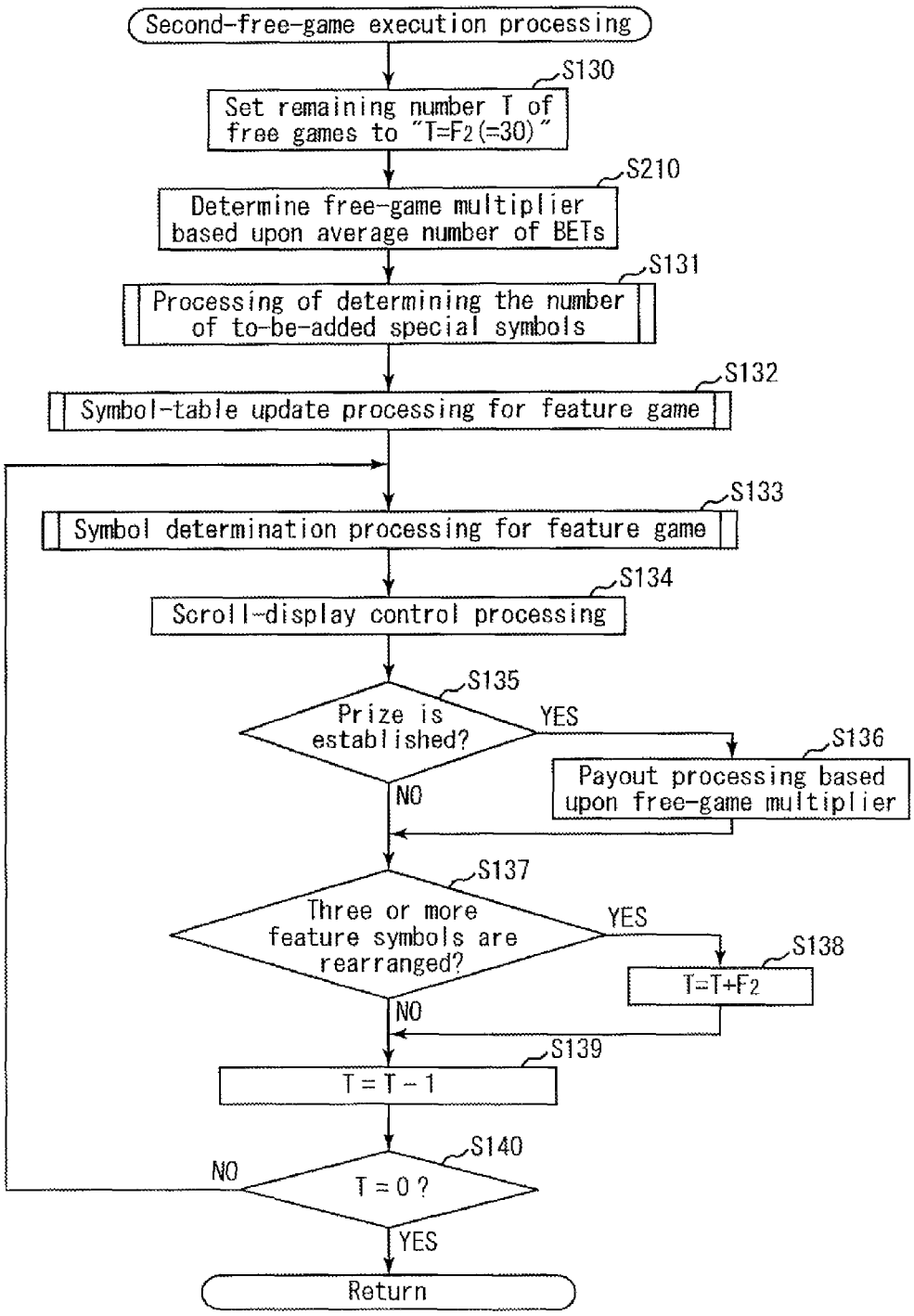
FIG. 23 is a flowchart showing a subroutine of second-free-game execution processing.

FIG. 23 is a flowchart showing a subroutine of second-free-game execution processing.

First, the main CPU 41 sets the remaining number T of the free games to "$T=F_2$ (=30)" (step S130).

Next, the main CPU 41 determines the free-game multiplier based upon the average-number-of-BETs data stored in the average-number-of-BETs storage area in the RAM 43 (step S210). In this processing, the main CPU 41 determines N which satisfies N≤(average number of BETS)<N+1, as the free-game multiplier. Then, the main CPU 41 stores the free-game-multiplier data indicative of the determined free-game multiplier in the free-game-multiplier storage area in the RAM 43.

After executing the processing of step S130 and step S210, the main CPU 41 displays the reaching effect image 201 (cf. FIG. 15) to the lower image display panel 16.

Subsequently, the main CPU 41 executes the processing of steps S131 to S140. Since these processing are the same as the processing of steps S31 to S40 in FIG. 11, the description thereof is omitted here.

As above, the second-free-game execution processing executed in step S105 in FIG. 21 has been described by using FIG. 23.

After executing the processing of step S105, the main CPU 41 clears the insurance flag (step S106).

Then, the main CPU 41 sets the number C of the with-insurance games to "C=0" in the storage area of the number of the with-insurance games of the RAM 43 (step S107).

As above, the present embodiment has been described.

According to the slot machine 10 of the present embodiment, the second free game is executed when the number C of the with-insurance games has reached the prescribed number (1000) In the second free game, the amount of payout is determines based upon the average number of BETs. Then, coins of the determined amount of payout are paid out.

The average number of BETs represents the amount invested by the player in the normal games, and is a symbol for the player, which represents his or her effort made until the second free game is generated.

According to the slot machine 10 of the present embodiment, the number of coins to be paid out in the second free game is determined based upon this kind of value, and therefore, it is possible to provide the player with a certain sense of achievement in that his or her BETs in the normal games are rewarded.

Further, even in a case where the amount of BET placed in each normal game is uneven, the number of coins to be paid out in the second free game is determined based upon the average value of those amounts of BET. Accordingly, it is possible to give the player an impression of being fair.

Furthermore, the more coins the player bets in the normal games, the more coins the player may acquire in the second free game. Accordingly, it is possible to encourage the player to bet a lot of game media, so as to be able to aim the increase in the profit of the recreation facility.

Further, according to the slot machine 10 of the present embodiment, the mode is shifted from the non-insurance mode to the insurance mode, on condition that the insurance BET button 90 is pressed. The number of coins to be paid out in the insured free game is determined based upon the average value of the number of coins betted in the normal games played in the insurance mode.

Accordingly, by determining timing to shift the mode to the insurance mode, the player can determine the timing when normal games start to be subject to calculation of the average value of the amount of BET by his or her own choice.

Among the players playing a game on a slot machine, there is a player who plays a game by betting a small amount of game media at the start of the game to see what that slot machine is like, and increases the amount of game media to bet after finding out what that slot machine is like. According to the slot machine 10 of the present embodiment, it is possible to have the player determine the timing to shift the mode to the insurance mode after finding out what that slot machine is like. Namely, the normal game at the start, in which the player bets only a small number of coins, is not subject to calculation of the average number of BETs, and therefore, it is possible to provide such player with a feeling of satisfaction.

According to the slot machine 10 of the present embodiment, the number C of the with-insurance games is counted, and the second free game is generated when the number of counted normal games has reached the prescribed number (e.g. 1000).

Accordingly, the second free game may be generated after the normal games are played for a comparatively long time. Further, it is highly possible that the player has a special feeling for the average number of BETs in that the player has placed BETs repeatedly for a long time. According to the slot machine 10 of the present embodiment, the number of coins to be paid out in the second free game is determined based upon this kind of average number of BETs, and therefore, it is possible to enhance the player's sense of achievement that his or her BETs in the normal games are rewarded.

Further, according to the slot machine 10 of the present embodiment, the first free game is executed when three or more feature symbols 100 are rearranged in the normal game conducted in the non-insurance mode. The amount of the game media to be paid out in the first free game is determined based upon the number of coins betted in the normal game in which three or more feature symbols 100 have been rearranged.

Accordingly, if a lot of game media had been betted in the normal game in which three or more feature symbols have been rearranged, the player may acquire a lot of game media in the first free game, even the amount of the game media betted in the previous normal game is small. Thus, it is possible to provide such player with a feeling of satisfaction. Further, it is possible to provide a high-risk-high-return game in that regard.

Generally, among the players playing a game on a slot machine, there are a player who prefers a high-risk-high-return game and a player who prefers a game ensuring the fairness. According to the slot machine 10 of the present embodiment, it is possible to have the player play a game of his or her choice by selecting whether or not to shift the mode to the insurance mode.

According to the slot machine 10 of the present embodiment, the number of pay lines is larger in the normal game conducted in the insurance mode than in the normal game conducted in the non-insurance mode. Namely, the player can increase the number of pay lines by shifting the mode to the insurance mode.

Accordingly, it is possible to encourage the player who is not sure whether or not to shift the mode to the insurance mode, to shift the mode to the insurance mode. Accordingly, it becomes possible to have more players to play the insured free game and to provide the player with the feeling of satisfaction that his or her BETs in the normal games are rewarded.

There has been described a case where the number of the normal games to be counted is the number C of the with-insurance games, in the present embodiment. However, in the present invention, the number of the normal games to be counted is not limited to this example. For example, the configuration may be adopted, in which a number M of the maximum BET games is counted. Here, the number M of the maximum BET games is the number of the normal games played with a BET of coins in the maximum number of BETs. The maximum number of BETs is the maximum number of coins which can be betted in one game. Accordingly, it is possible to encourage the player to bet the game media in number equal to the maximum number of BETs.

Further, for example, the configuration may be adopted, in which the number of the normal games in which symbols are stop-displayed in a predetermined stopped state is counted. Accordingly, it is possible to have the player have expectations for the stop-display of the symbols in the predetermined stopped state.

In the present embodiment, the case has been described where the predetermined condition is that three or more feature symbols are rearranged. However, the predetermined condition in the present invention is not particularly limited.

Examples of the predetermined condition may include the elapse of the predetermined time period after completion of the previous feature game. Further, the examples may also include a condition that a random number is extracted for every prescribed number of games being conducted, and the extracted random number belongs to the predetermined numerical range.

Further, a probability of establishment of the specific condition may be configured to be different in each game. In such a case, it is possible to have the player play the game with the aim of betting a lot of game media in the game having the high probabilities of establishment of the specific condition. In this case, it is desirable to adopt the configuration in which timing of the generation of a game having a high probability of establishment of the specific condition is indicated to the player so that the player can predict the generation of that game. For example, it is possible to adopt the configuration in which predetermined symbols are variably displayed or stop-displayed before the game having the high probability of establishment of the specific condition is conducted.

Further, in the present embodiment, there has been described the case where the predetermined condition is the number of the counted normal games reaching the prescribed number (1000). However, the predetermined condition in the present invention is not limited to this example. For example, a condition that a random number is extracted for every prescribed number of games being conducted, and the extracted random number belongs to the predetermined numerical range, may be adopted as the predetermined condition. Further, the predetermined condition may be a condition that the difference between the amount of the betted game media and the amount of the paid-out game media reaches the predetermined amount.

Furthermore, a condition that points are offered based upon the stop-displayed symbol or a combination of the stop-displayed symbols and the offered points reaches the prescribed number may be adopted as the predetermined condition.

Further, in the present embodiment, there has been described the case where only the number of the normal games is counted. However, in the present invention, the number of the free games may also be counted. For example, the second free game may be configured to be generated, when a total of the number of the normal games and the number of the first free games has reached the prescribed number.

Furthermore, in the present embodiment, the free-game multiplier is determined based upon the average number of BETs, and in the free game, the amount of payout is determined assuming that coins in number corresponding to the free-game multiplier are betted. In this regard, the amount of payout in the free game is determined based upon the average number of BETs. However, in the present invention, processing relating to the determination of the amount of payout in the free game is not limited to this example.

For example, the following configuration may be listed.

Namely, a plurality of kinds of odds can be set in the free game. Then, based upon the average number of BETs, one kind of odds is specified out of the plurality of kinds of odds. Further, the amount of payout is determined based upon the specified odds.

Accordingly, it is possible to provide the free game, in which the amount of payout is determined based upon comparatively large odds when the value of the average number of BETs is large, and the amount of payout is determined based upon comparatively small odds when the value of the average number of BETs is small.

Further, the configuration may be adopted, in which the number of the counted normal games is cleared in a case where the predetermined amount or more of the game media are paid out in the insurance mode. In this case, while the player may raise the probability that the number of the counted normal games is cleared by betting a lot of game media, the player cannot increase the average number of BETs if he or she bets only a small amount of game media. Accordingly, it is possible to have the player try to figure out the best amount of the game media to bet. It is possible to have the player absorbed in the game through such process.

Although the embodiments of the present invention were described above, they were just illustrations of specific examples, and hence do not particularly restrict the present invention. A specific configuration of each step and the like is appropriately changeable in terms of design. Further, the effects described in the embodiments of the present invention are just recitations of the most suitable effects generated from the present invention. The effects of the present invention are thus not limited to those described in the embodiments of the present invention.

Further, the foregoing detailed descriptions centered the characteristic parts of the present invention in order to facilitate understanding of the present invention. The present invention is not limited to the embodiments in the foregoing specific descriptions but applicable to other embodiments with a variety of application ranges. Further, terms and phrases in the present specification were used not for restricting interpretation of the present invention but for precisely describing the present invention. It is considered easy for the skilled in the art to conceive other configurations, systems, methods and the like included in the concept of the present invention from the concept of the invention described in the specification. Therefore, it should be considered that recitations of the claims include uniform configurations in a range not departing from the range of technical principles of the present invention. Moreover, an object of the abstract is to enable a patent office, a general public institution, an engineer belonging to the technical field who is unfamiliar with patent, technical jargon or legal jargon, and the like, to smoothly determine technical contents and an essence of the present application with simple investigation. Accordingly, the abstract is not intended to restrict the scope of the invention which should be evaluated by recitations of the claims. Furthermore, for thorough understanding of an object of the present invention and an effect specific to the present invention, it is desired to make interpretation in full consideration of documents already disclosed and the like.

The foregoing detailed descriptions include processing executed on a computer or a computer network. Explanations and expressions above are described with the aim of being most efficiently understood by the skilled person in the art. In the specification, each step for use in deriving one result should be understood as the self-consistent processing. Further, in each step, transmission/reception, recording or the like of an electrical or magnetic signal is performed. While such a signal is expressed by using a bit, a value, a symbol, a letter, a term, a number or the like in processing of each step, it should be noted that those are used simply for the sake of convenience in description. While there are cases where processing in each step may be described using an expression in common with that of action of a human, processing described in the specification is essentially executed by a variety of devices. Further, another configuration requested for performing each step should become apparent from the above descriptions.

What is claimed as new and desired to be secured by Letters Patent of the United States is:

1. A slot machine comprising:

a bet input device capable of receiving an input of a bet;

a symbol display capable of variably displaying a plurality of symbols;

a value display; and a controller, said controller programmed to perform the processing steps of:

(A) receiving an input of a bet through said bet input device;

(B) executing a normal game in which said plurality of symbols are variably displayed and then stop-displayed to said symbol display after the input of the bet in said processing step (A), an amount of payout is determined based upon a stop-displayed symbol or a combination of stop-displayed symbols and an amount of game media betted in said processing step (A), and game media of the determined amount of payout are paid out;

(C) shifting a mode from a non-insurance mode to an insurance mode on condition that a predetermined number of game media are inserted, wherein said shifting occurs as a result of a user input to the slot machine;

(D) calculating an average amount of game media bet in the insurance mode by dividing a total amount of the game media betted in said processing step (A) in the insurance mode by the number of bets in the insurance mode;

(E) displaying on the value display the average amount of game media bet in the insurance mode, calculated in said processing step (D), while in the insurance mode; and (F) executing an insured free game when a predetermined condition is satisfied in the insurance mode, said insured free game being a game in which said plurality of symbols are variably displayed and then stop-displayed to said symbol display even without a bet of game media, the amount of payout is determined based upon a payout multiplier and either a stop-displayed symbol or a combination of stop-displayed symbols wherein the payout multiplier is determined using the average amount of game media bet in the insurance mode calculated in said processing step (D), and game media of the determined amount of payout are paid out.

2. The slot machine of claim 1, wherein, in the insurance mode, the value display displays both the average amount of game media bet in the insurance mode calculated in said processing step (D) and the total amount of the game media betted while in the insurance mode in said processing step (A).

3. The slot machine of claim 1, wherein in the processing step (A), the received input bet is limited to a maximum bet value;

in the processing step (F), the predetermined condition for executing an insured free game is satisfied when a total number of normal games executed in the insurance mode reaches a predetermined number; and processing step (E) further comprises displaying the total number of normal games executed in the insurance mode, the predetermined number, or the difference between the predetermined number and the total number of normal games.

4. The slot machine of claim 1, wherein the controller is further programmed to perform the processing step of:

(G) executing a free feature game when a second predetermined condition is satisfied, said free feature game being a game in which said plurality of symbols are variably displayed and then stop-displayed to said symbol display even without a bet of game media, the amount of payout is determined based upon a feature payout multiplier and either a stop-displayed symbol or a combination of stop-displayed symbols, wherein the feature payout multiplier is not determined using the average amount of game media bet in the insurance mode, calculated in said processing step (D), and game media of the determined amount of payout are paid out.

5. The slot machine of claim 1, further comprising an insurance mode button configured to provide the user input in the processing step (c).

6. A slot machine comprising:

a bet input device capable of receiving an input of a bet;

a symbol display capable of variably displaying a plurality of symbols; and a controller, said controller programmed to perform the processing steps of:

(A) receiving an input of a bet through said bet input device;

(B) executing a normal game in which said plurality of symbols are variably displayed and then stop-displayed to said symbol display after the input of the bet in said processing step (A), an amount of payout is determined based upon a stop-displayed symbol or a combination of stop-displayed symbols and an amount of game media betted in said processing step (A), and game media of the determined amount of payout are paid out;

(C) shifting a mode from a non-insurance mode to an insurance mode on condition that a predetermined number of game media are inserted, wherein said shifting occurs as a result of a user input to the slot machine;

(D) calculating an average amount of game media bet in the insurance mode by dividing a total amount of the game media betted in said processing step (A) executed in said insurance mode by the number of bets in the insurance mode; and (E) executing an insured free game when a predetermined condition is satisfied in said insurance mode, said insured free game being a game in which said plurality of symbols are variably displayed and then stop-displayed to said symbol display even without a bet of game media, the amount of payout is determined based upon a payout multiplier and either a stop-displayed symbol or a combination of stop-displayed symbols, wherein the payout multiplier is determined using the average amount of game media bet in the insurance mode calculated in said processing step (D), and game media of the determined amount of payout are paid out.

7. The slot machine according to claim 6, wherein said controller is further programmed to perform the processing step of (F) counting the number of the normal games executed in said processing step (B) in said insurance mode, and said processing step (E) comprises executing the insured free game when the number counted in said processing step (F) has reached a prescribed number.

8. The slot machine according to claim 6, wherein said controller is further programmed to perform the processing step of (F) executing an uninsured free game when a specific condition different from said predetermined condition is satisfied in the normal game executed in said non-insurance mode, said uninsured free game being a game in which said plurality of symbols are variably displayed and then stop-displayed to said symbol display even without a bet of game media, an amount of payout is determined based upon a stop-displayed symbol or a combination of stop-displayed symbols and the amount of game media betted in the normal game in which said specific condition has been satisfied, and game media of the determined amount of payout are paid out.

9. The slot machine according to claim 6, wherein said processing step (B) comprises:

(B-1) executing in said non-insurance mode an uninsured normal game in which said plurality of symbols are variably displayed and then stop-displayed to said symbol display after the input of the bet in said processing step (A), the amount of payout is determined based upon a symbol or a combination of symbols stop-displayed on a predetermined number of pay lines set on said symbol display and the amount of the game media betted in said processing step (A), and game media of the determined amount of payout are paid out; and (B-2) executing in said insurance mode an insured normal game in which said plurality of symbols are variably displayed and then stop-displayed to said symbol display after the input of the bet in said processing step (A), the amount of payout is determined based upon a symbol or a combination of symbols stop-displayed on a specific number of pay lines set on said symbol display and the amount of the game media betted in said processing step (A), said specific number being larger than said predetermined number, and game media of the determined amount of payout are paid out.

10. The slot machine of claim 6, further comprising:

a value display, wherein the value display displays the average amount of game media bet in the insurance mode calculated in said processing step (D) or the total amount of the game media betted while in the insurance mode in said processing step (A).

11. The slot machine of claim 6, wherein in the processing step (A), the received input bet is limited to a maximum bet value; and in the processing step (E), the predetermined condition for executing an insured free game is satisfied when a total number of normal games executed in the insurance mode reaches a predetermined number.

12. The slot machine of claim 6, wherein the controller is further programmed to perform the processing step of:

(F) executing a free feature game when a second predetermined condition is satisfied, said free feature game being a game in which said plurality of symbols are variably displayed and then stop-displayed to said symbol display even without a bet of game media, the amount of payout is determined based upon a feature payout multiplier and either a stop-displayed symbol or a combination of stop-displayed symbols, wherein the feature payout multiplier is not determined using the average amount of game media bet in the insurance mode, calculated in said processing step (D), and game media of the determined amount of payout are paid out.

13. The slot machine of claim 6, further comprising an insurance mode button configured to provide the user input in the processing step (c).

14. A control method of a slot machine, said control method comprising the steps of:

(A) receiving an input of a bet from a bet input device;

(B) executing a normal game in which a plurality of symbols are variably displayed and then stop-displayed to a symbol display after the input of the bet in said step (A), an amount of payout is determined based upon a stop-displayed symbol or a combination of stop-displayed symbols and an amount of game media betted in said step (A), and game media of the determined amount of payout are paid out;

(C) shifting a mode from a non-insurance mode to an insurance mode on condition that a predetermined number of game media are inserted, wherein said shifting occurs as a result of a user input to the slot machine;

(D) calculating an average amount of game media bet in the insurance mode by dividing a total amount of the game media betted in said processing step (A) in the insurance mode by the number of bets in the insurance mode;

(E) displaying on a value display the average amount of game media bet in the insurance mode, calculated in said step (D), while in the insurance mode; and (F) executing an insured free game when a predetermined condition is satisfied in the insurance mode, said insured free game being a game in which said plurality of symbols are variably displayed and then stop-displayed to said symbol display even without a bet of game media, the amount of payout is determined based upon a payout multiplier and either a stop-displayed symbol or a combination of stop-displayed symbols, wherein the payout multiplier is determined using the average amount of game media bet in the insurance mode calculated in said processing step (D), and game media of the determined amount of payout are paid out.

15. The control method of claim 14, wherein step (E) further comprises displaying on the value display both the average amount of game media calculated in step (C) and the total amount of the game media betted while in the insurance mode in said processing step (A).

16. The control method of claim 14, wherein in the processing step (A), the received input bet is limited to a maximum bet value;

in the processing step (F), the predetermined condition for executing an insured free game is satisfied when a total number of normal games executed in the insurance mode reaches a predetermined number; and processing step (E) further comprises displaying the total number of normal games executed in the insurance mode, the predetermined number, or the difference between the predetermined number and the total number of normal games.

17. The control method of claim 14, further comprising the step:

(G) executing a free feature game when a second predetermined condition is satisfied, said free feature game being a game in which said plurality of symbols are variably displayed and then stop-displayed to said symbol display even without a bet of game media, the amount of payout is determined based upon a feature payout multiplier and either a stop-displayed symbol or a combination of stop-displayed symbols, wherein the feature payout multiplier is not determined using the average amount of game media bet in the insurance mode, calculated in said processing step (D), and game media of the determined amount of payout are paid out.

18. The control method of claim 14, wherein the slot machine further comprises an insurance mode button configured to provide the user input in the processing step (c).

19. A control method of a slot machine, said control method comprising the steps of:

(A) receiving an input of a bet from a bet input device;

(B) executing a normal game in which a plurality of symbols are variably displayed and then stop-displayed to a symbol display after the input of the bet in said step (A), an amount of payout is determined based upon a stop-displayed symbol or a combination of stop-displayed symbols and an amount of game media betted in said step (A), and game media of the determined amount of payout are paid out;

(C) shifting a mode from a non-insurance mode to an insurance mode on condition that a predetermined number of game media are inserted, wherein said shifting occurs as a result of a user input to the slot machine;

(D) calculating an average amount of game media bet in the insurance mode by dividing a total amount of the game media betted in said step (A) executed in said insurance mode by the number of bets in the insurance mode; and (E) executing an insured free game when a predetermined condition is satisfied in said insurance mode, said insured free game being a game in which said plurality of symbols are variably displayed and then stop-displayed to said symbol display even without a bet of game media, the amount of payout is determined based upon a payout multiplier and either a stop-displayed symbol or a combination of stop-displayed symbols, wherein the payout multiplier is determined using the average amount of game media bet in the insurance mode calculated in said processing step (D), and game media of the determined amount of payout are paid out.

20. The control method of claim 19, wherein step (D) further comprises the step of displaying on a value display the average amount of game media bet in the insurance mode calculated in step (D) or the total amount of the game media betted while in the insurance mode in said processing step (A).

21. The control method of claim 19, wherein in the processing step (A), the received input bet is limited to a maximum bet value; and in the processing step (E), the predetermined condition for executing an insured free game is satisfied when a total number of normal games executed in the insurance mode reaches a predetermined number.

22. The control method of claim 19, further comprising the step:

(F) executing a free feature game when a second predetermined condition is satisfied, said free feature game being a game in which said plurality of symbols are variably displayed and then stop-displayed to said symbol display even without a bet of game media, the amount of payout is determined based upon a feature payout multiplier and either a stop-displayed symbol or a combination of stop-displayed symbols, wherein the feature payout multiplier is not determined using the average amount of game media bet in the insurance mode, calculated in said processing step (D), and game media of the determined amount of payout are paid out.

23. The control method of claim 19, wherein the slot machine further comprises an insurance mode button configured to provide the user input in the processing step (c).

* * * * *

UNITED STATES PATENT AND TRADEMARK OFFICE

CERTIFICATE OF CORRECTION

PATENT NO. : 8,636,580 B2
APPLICATION NO. : 12/589512
DATED : January 28, 2014
INVENTOR(S) : Yukinori Inamura et al.

It is certified that error appears in the above-identified patent and that said Letters Patent is hereby corrected as shown below:

In the Specification

Column 10, line 26: “10” should read -- 1D --.

Column 16, line 58: “3005” should read -- 300B --.

Column 16, line 59: “3000” should read -- 300C --.

Column 18, line 63: “number-of-data stored BETs” should read -- number-of-BETs data stored --.

Column 22, line 38: “130” should read -- 13C --.

Column 22, line 60: “302D” should read -- 302B --.

Column 23, line 12: “3020” should read -- 302C --.

Column 23, line 13: “3023” should read -- 302E --.

Column 23, line 20: “3020” should read -- 302C --.

Column 23, line 21: “3023” should read -- 302E --.

Column 27, line 31: “15” should read -- 1B --.

Signed and Sealed this
First Day of July, 2014

Michelle K. Lee

Michelle K. Lee
*Deputy Director of the United States Patent and Trademark Office*